US010784098B2

(12) United States Patent
Chernushevich et al.

(10) Patent No.: US 10,784,098 B2
(45) Date of Patent: Sep. 22, 2020

(54) TWO-AND-A-HALF CHANNEL DETECTION SYSTEM FOR TIME-OF-FLIGHT (TOF) MASS SPECTROMETER

(71) Applicant: DH TECHNOLOGIES DEVELOPMENT PTE. LTD., Singapore (SG)

(72) Inventors: Igor Chernushevich, Toronto (CA); Nic G. Bloomfield, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/490,400

(22) PCT Filed: Mar. 1, 2018

(86) PCT No.: PCT/IB2018/051317
§ 371 (c)(1),
(2) Date: Aug. 30, 2019

(87) PCT Pub. No.: WO2018/167595
PCT Pub. Date: Sep. 20, 2018

(65) Prior Publication Data

US 2020/0020517 A1 Jan. 16, 2020

Related U.S. Application Data

(60) Provisional application No. 62/470,486, filed on Mar. 13, 2017.

(51) Int. Cl.
*H01J 49/40* (2006.01)
*H01J 49/02* (2006.01)
(Continued)

(52) U.S. Cl.
CPC ..... *H01J 49/405* (2013.01); *H01J 49/0009* (2013.01); *H01J 49/025* (2013.01); *H01J 49/06* (2013.01)

(58) Field of Classification Search
CPC ..... H01J 49/0009; H01J 49/025; H01J 49/06; H01J 49/40; H01J 49/405; G01T 1/24; G01T 1/247
See application file for complete search history.

(56) References Cited

U.S. PATENT DOCUMENTS 7,084,393 B2 * 8/2006 Fuhrer ..... H01J 49/0036 250/283
2003/0111597 A1 * 6/2003 Gonin ..... H01J 49/025 250/287

(Continued)

OTHER PUBLICATIONS

International Search Report and Written Opinion for PCT/IB2018/051317, dated Jun. 15, 2018.

*Primary Examiner* — David E Smith
(74) *Attorney, Agent, or Firm* — John R. Kasha; Kelly L. Kasha; Kasha Law LLC

(57) ABSTRACT

Two-channel electrical and photo-electrical TOF ion detection systems are provided. These systems maintain the resolution and dynamic range advantages of four-channel systems but at a lower cost. Electrodes or light pipes are configured to direct electrons or photons produced by ion impacts into two separate channels. The first channel receives electrons or photons resulting from the inner or central part of the rectangular pattern of each ion impact. The second channel receives electrons or photons resulting from the two outer ends of the rectangular pattern of each ion impact. In a two-channel digitizer, the first channel and the second channel are independently calibrated to align the first digital value and the second digital value in time and account for the convex shape of the ion impacts of each ion packet and/or the curvature of a microchannel plate.

15 Claims, 15 Drawing Sheets

(51) Int. Cl.
*H01J 49/00* (2006.01)
*H01J 49/06* (2006.01)

(56) References Cited

U.S. PATENT DOCUMENTS

| | | | | |
|---|---|---|---|---|
| 2005/0040325 | A1* | 2/2005 | Gonin | H01J 49/025 250/287 |
| 2005/0056779 | A1 | 3/2005 | Chefetz et al. | |
| 2007/0018113 | A1* | 1/2007 | Gonin | H01J 49/025 250/397 |
| 2008/0290267 | A1* | 11/2008 | Hayashi | H01J 49/025 250/282 |
| 2010/0243887 | A1 | 9/2010 | Suyama et al. | |
| 2011/0095177 | A1 | 4/2011 | Giannakopulos et al. | |
| 2014/0246575 | A1* | 9/2014 | Langridge | H01J 49/0009 250/282 |
| 2014/0246579 | A1 | 9/2014 | Hoyes et al. | |

* cited by examiner

800

TWO-AND-A-HALF CHANNEL DETECTION SYSTEM FOR TIME-OF-FLIGHT (TOF) MASS SPECTROMETER

CROSS REFERENCE TO RELATED APPLICATION

This application claims the benefit of U.S. Provisional Patent Application Ser. No. 62/470,486, filed Mar. 13, 2017, the content of which is incorporated by reference herein in its entirety.

INTRODUCTION

The teachings herein relate to an ion detection system for a time-of-flight (TOF) mass analyzer or mass spectrometer. More particularly, the teachings herein relate to an ion detection system that includes a novel arrangement of electrodes or light pipes and a two-channel digitizer that allows the ion detection system to account for the non-uniform shapes of ion packets and the non-uniform shapes of microchannel plates without sacrificing dynamic range or resolution.

BACKGROUND

Currently, some conventional TOF mass analyzers use ion detection systems that include four-channel digitizers. A four-channel digitizer can include either a time-to-digital converter (TDC) or an analog-to-digital converter (ADC), for example. Multichannel ion detection systems provide two main benefits: enhanced dynamic range and improved resolution through independent calibration of channels (also known as channel alignment). The use of analog detection can in principle replace the need for multiple channels from a dynamic range aspect, which may also result in better timing resolution of an ADC. However, the channel alignment benefit would disappear. This can be partially compensated for by various means of tilting either the ion packet or detector itself, but it does not remove the adverse effect of the ion packet curvature on resolution. Therefore, expensive four-channel ADCs have conventionally been used.

Unfortunately, however, four-channel TDC or ADC digitizers can account for close to 10% of the cost of a TOF mass spectrometer. As a result, there is a need for multichannel ion detection systems that can provide the same dynamic range and resolution as four-channel systems but at a lower cost.

SUMMARY

Two-channel electrical, photo-electrical, and planar photo-electrical TOF ion detection systems are provided. These systems maintain the resolution and dynamic range advantages of four-channel systems but at a lower cost.

The electrical two-channel ion detection system includes a series of one or more microchannel plates (MCPs), two or more segmented anode electrodes plates, and two-channel digitizer. The series of one or more MCPs is impacted by ion packets in a rectangular pattern on a first side. The series converts the impacts into multiplied electrons emitted in the rectangular pattern on a second side. Ions of each ion packet impact the first side at different times along the length of the rectangular pattern following a convex shape. Due to the convex shape of the ion packets, ions of each packet impact a central inner area of the rectangular pattern before impacting two outer areas at each end of the rectangular pattern.

Two or more segmented anode electrode plates are arranged in a plane parallel with the series of one or more MCPs and are positioned next to the series of one or more MCPs to receive the emitted electrons from the rectangular pattern on the second side. They include one or more inner electrodes positioned to receive emitted electrons from the central inner area of the rectangular pattern and one or more outer electrodes positioned to receive emitted electrons from the two outer areas at each end of the rectangular pattern.

The two-channel digitizer includes a first channel electrically connected to one or more inner electrodes that converts the electrons received into a first digital value. It includes a second channel electrically connected to the one or more outer electrodes that converts the electrons received into a second digital value. The first channel and the second channel are independently calibrated to align the first digital value and the second digital value in time and account for the convex shape of the ion impacts of each ion packet and/or the curvature of the series of one or more MCPs.

The photo-electrical two-channel ion detection system includes series of one or more MCPs, a scintillator, two or more segmented light pipes, a first photo-multiplier tube (PMT), a second PMT, and a two-channel digitizer.

The series of one or more MCPs is impacted by ion packets in a rectangular pattern on a first side. They convert the impacts into multiplied electrons emitted in the rectangular pattern on a second side. Ions of each ion packet impact the first side at different times along the length of the rectangular pattern following a convex shape. Due to the convex shape of the ion packets, ions of each packet impact a central inner area of the rectangular pattern before impacting two outer areas at each end of the rectangular pattern.

The scintillator is positioned next to and in parallel with the series of one or more MCPs. The scintillator receives the emitted electrons in the rectangular pattern on a first side from the second side of the series of one or more MCPs. The scintillator converts the electrons into photons emitted in the rectangular pattern on its second side.

Two or more segmented light pipes are connected to the second side of the scintillator to receive the photons emitted. They include one or more inner light pipes positioned to receive photons from the central inner area of the rectangular pattern and one or more outer light pipes positioned to receive photons from the two outer areas at each end of the rectangular pattern.

The first PMT is connected to one or more inner light pipes and converts the photons received into first multiplied electrons for each packet. The second PMT is connected to one or more outer light pipes and converts the photons received into second multiplied electrons for each packet.

The two-channel digitizer includes a first channel electrically connected to the first PMT that converts the first multiplied electrons for each ion packet into a first digital value and a second channel electrically connected to the second PMT that converts the second multiplied electrons for each ion packet into a second digital value. The first channel and the second channel are independently calibrated to align the first digital value and the second digital value in time and account for the convex shape of the ion impacts of each ion packet and/or the curvature of the series of one or more MCPs.

The planar photo-electrical two-channel ion detection system includes a magnet, a plurality of conducting meshes that are transparent to ions, a planar ion-to-electron converter, a scintillator, two or more segmented light pipes, a first photo-multiplier tube (PMT), a second PMT, and a two-channel digitizer.

The magnet is used to produce a magnetic field. The plurality of conducting meshes are biased by a voltage source to produce an electric field.

The planar ion-to-electron converter is impacted by ion packets in a rectangular pattern on a first side. The planar ion-to-electron converter converts the impacts into multiplied electrons emitted in the rectangular pattern on the same first side. Ions of each ion packet impact the first side at different times along the length of the rectangular pattern following a convex shape. Due to the convex shape of the ion packets, ions of each packet impact a central inner area of the rectangular pattern before impacting two outer areas at each end of the rectangular pattern.

The scintillator is positioned side by side with the planar ion-to-electron converter. The scintillator receives the emitted electrons in the rectangular pattern on a first side from the first side of the planar ion-to-electron converter. The scintillator converts the electrons into photons emitted in the rectangular pattern on its second side. The magnet and the plurality of conducting meshes are positioned to create the magnetic field and the electric field in front of the first side of the planar ion-to-electron converter and the first side of the scintillator so that the magnetic field and the electric field send the emitted electrons in a semi-circular path from the planar ion-to-electron converter to the scintillator.

Two or more segmented light pipes are connected to the second side of the scintillator to receive the photons emitted. They include one or more inner light pipes positioned to receive photons from the central inner area of the rectangular pattern and one or more outer light pipes positioned to receive photons from the two outer areas at each end of the rectangular pattern.

The first PMT is connected to one or more inner light pipes and converts the photons received into first multiplied electrons for each packet. The second PMT is connected to one or more outer light pipes and converts the photons received into second multiplied electrons for each packet.

The two-channel digitizer includes a first channel electrically connected to the first PMT that converts the first multiplied electrons for each ion packet into a first digital value and a second channel electrically connected to the second PMT that converts the second multiplied electrons for each ion packet into a second digital value. The first channel and the second channel are independently calibrated to align the first digital value and the second digital value in time and account for the convex shape of the ion impacts of each ion packet and/or the curvature of the series of one or more MCPs.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
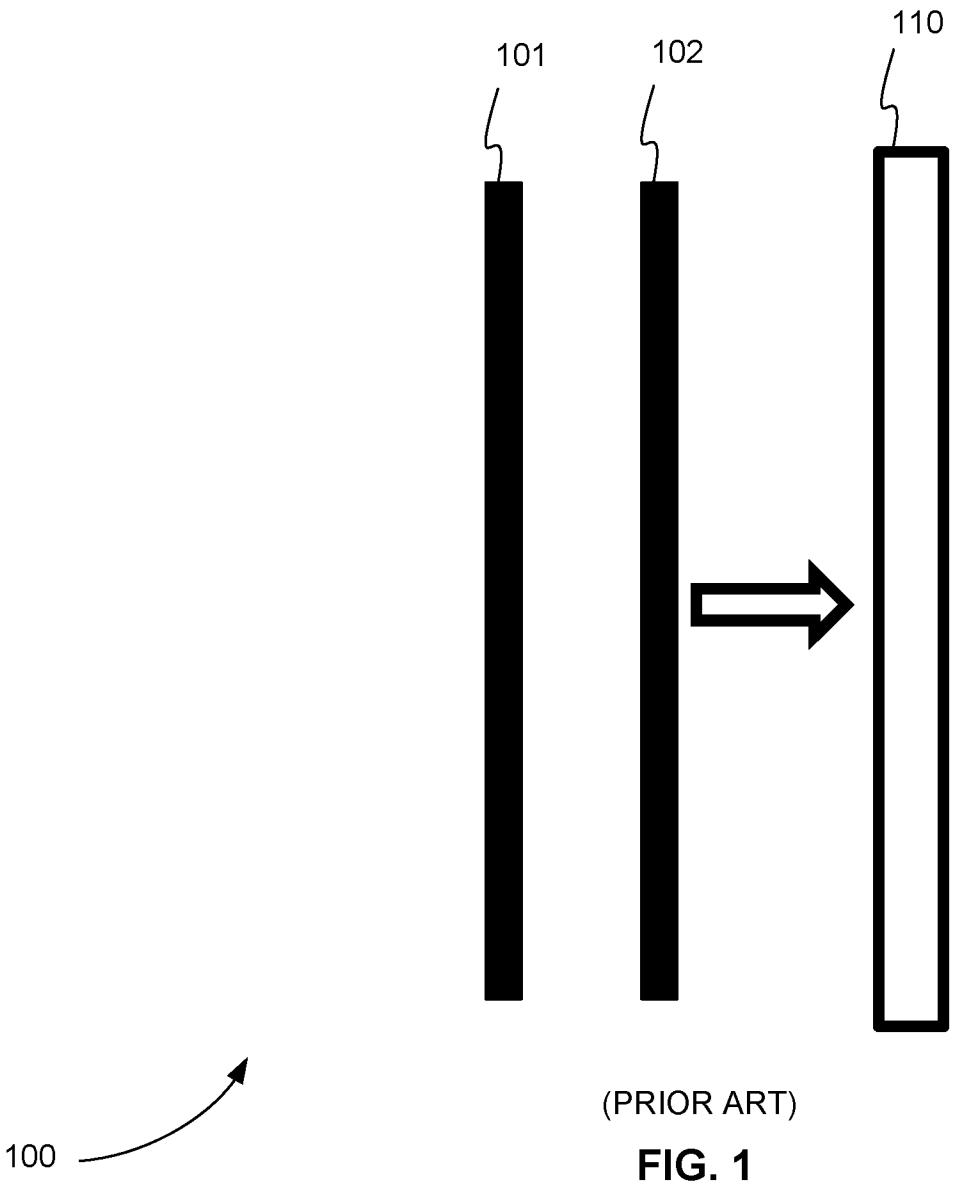
(PRIOR ART) FIG. 1
FIG. 1 is a side view of a time-of-flight (TOF) ion detection system showing exemplary ion packets that each has an ideal shape and an ideal orientation just before they impact a microchannel plate (MCP) of the TOF ion detection system.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Two-Channel Ion Detection System

As described above, some conventional time-of-flight (TOF) mass analyzers use ion detection systems that include four-channel digitizers. A four-channel digitizer can include either a time-to-digital converter (TDC) or an analog-to-digital converter (ADC), for example. Multichannel ion detection systems provide two main benefits: enhanced dynamic range and improved resolution through independent calibration of channels (also known as channel alignment).

Unfortunately, however, four-channel TDC or ADC digitizers are expensive and can account for close to 10% of the cost of a TOF mass spectrometer. As a result, there is a need for multichannel ion detection systems that can provide the same or similar dynamic range and resolution as four-channel systems but at a lower cost.

One of ordinary skill in the art can appreciate that the terms "mass analyzer" and "mass spectrometer" can be used interchangeably. Generally, a mass analyzer refers to a device at one or more stages of a mass spectrometer. In other words, the mass analyzer is typically just one component of a mass spectrometer. However, it is common in industry practice to refer to an entire mass spectrometer in terms of its mass analyzer. For example, a mass spectrometer that includes a TOF mass analyzer is often referred to as a TOF mass spectrometer even though the TOF mass analyzer is just one component.

Resolution and Channel Alignment

One of the benefits of a multichannel ion detection system is improved resolution through independent calibration of channels, called channel alignment. Channel alignment is needed due to the non-ideal way in which ion packets are shaped when they impact the detector.

FIG. 1 is a side view 100 of a TOF ion detection system showing exemplary ion packets that each has an ideal shape and an ideal orientation just before they impact a microchannel plate (MCP) of the TOF ion detection system. An MCP is a device that converts ion impacts on one side of the MCP to electron emissions on the corresponding other side of the MCP. Typically, an MCP produces many electrons for each ion impact. As a result, an MCP acts as a multiplier or amplifier of ion impacts. Due to this amplification effect, multiple MCPs can also be used in series to increase the amplification of ion impacts.

The shapes of ion packets 101 and 102 are ideal with respect to MCP 110 of FIG. 1 because they are essentially the same flat shape as MCP 110. In other words, due to this shape, all of the ions of ion packet 101 will strike MCP 110 at the same time and all of the ions of ion packet 102 will also strike MCP 110 at the same time.

The orientations of ion packets 101 and 102 are ideal with respect to MCP 110 because they are essentially parallel to MCP 110. Again, this orientation allows all of the ions of ion packet 101 to strike MCP 110 at the same time and all of the ions of ion packet 102 to strike MCP 110 at the same time.

The shape and orientation of ion packets are important because they affect the resolution of a TOF ion detection system. In a TOF ion detection system, resolution essentially refers to how well the distance between ion packets can be measured. In other words, the highest resolution would be the minimum distance between two ion packets where those two different ion packets could still be resolved.

The ideal shape and ideal orientation of ion packets 101 and 102 in FIG. 1 allows for a very high resolution. Ion packets with this shape and orientation can be resolved even if they are placed much closer than ion packets 101 and 102. Ion packets, however, with non-ideal shapes and non-ideal orientations can degrade resolution by increasing the minimum distance between two ion packets where those two different ion packets can still be resolved.

Figure 2:
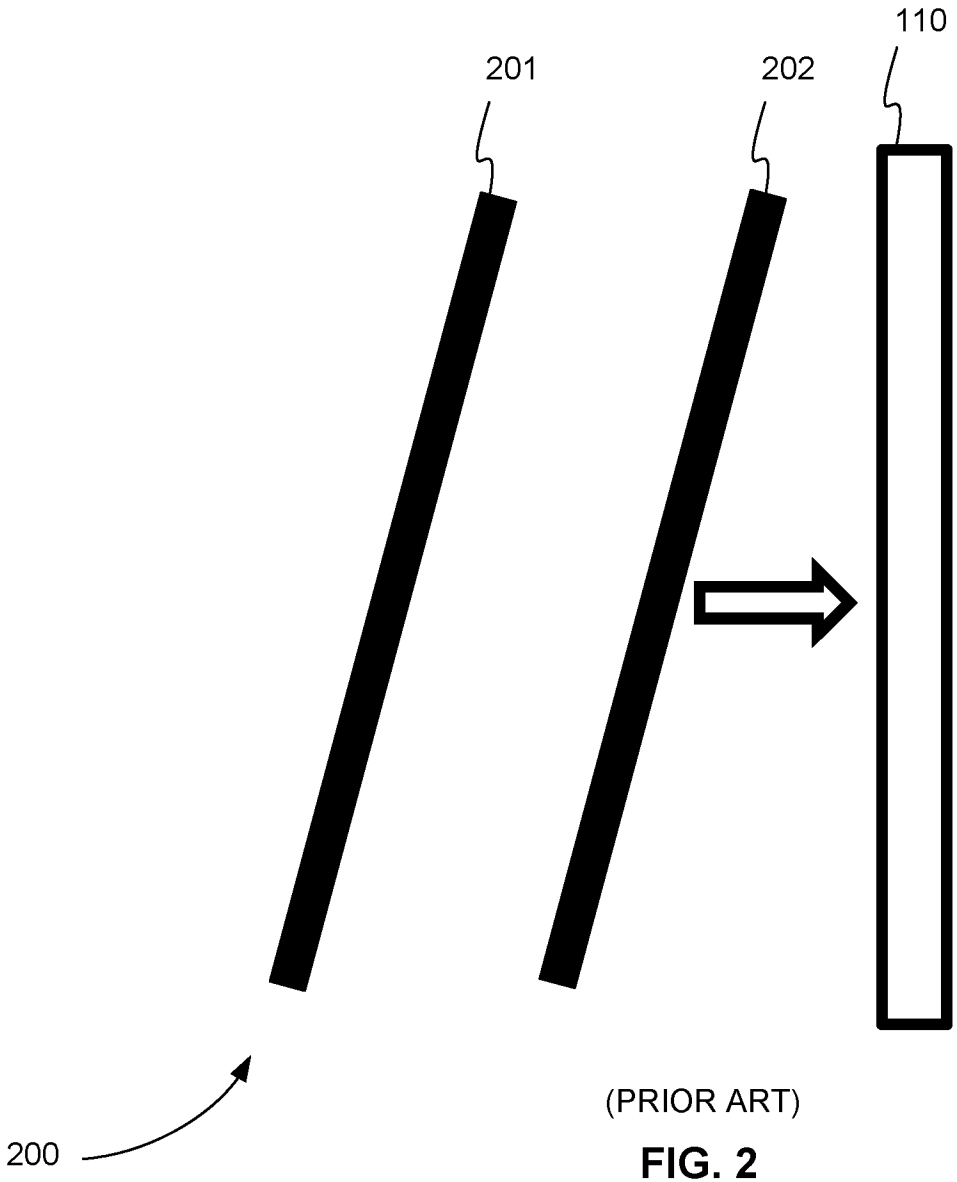
(PRIOR ART) FIG. 2
FIG. 2 is a side view of a TOF ion detection system showing exemplary ion packets that each has an ideal shape and a non-ideal orientation just before they impact an MCP of a TOF ion detection system.

FIG. 2 is a side view 200 of a TOF ion detection system showing exemplary ion packets that each has an ideal shape and a non-ideal orientation just before they impact an MCP of a TOF ion detection system. In FIG. 2, ion packets 201 and 202 are oriented at an angle, or are tilted, with respect to MCP 110. This tilting of ion packets 201 and 202 within the ion beam causes a decrease in resolution.

This decrease in resolution can be seen by determining if ion packets 201 and 202 can be placed closer together and still be distinguished at MCP 110. If ion packet 201 is placed closer to ion packet 202 its leading edge immediately starts to overlap the trailing edge of ion packet 202. If these edges overlap, the ion packets cannot be distinguished at MCP 110. This means that ion packets 201 and 202 cannot be placed much closer together. Therefore, a comparison of FIGS. 1 and 2 show how a non-ideal orientation can degrade resolution.

In practice, it is common for TOF mass analyzers to produce ion packets with tilted or non-ideal orientations. Fortunately, however, there is a conventional remedy to this problem. In order to compensate for the tilted packets, the MCP can be correspondingly tilted in a calibration step to account for ion packets with tilted or non-ideal orientations. Non-ideal ion packet shape can also degrade resolution.

Figure 3:
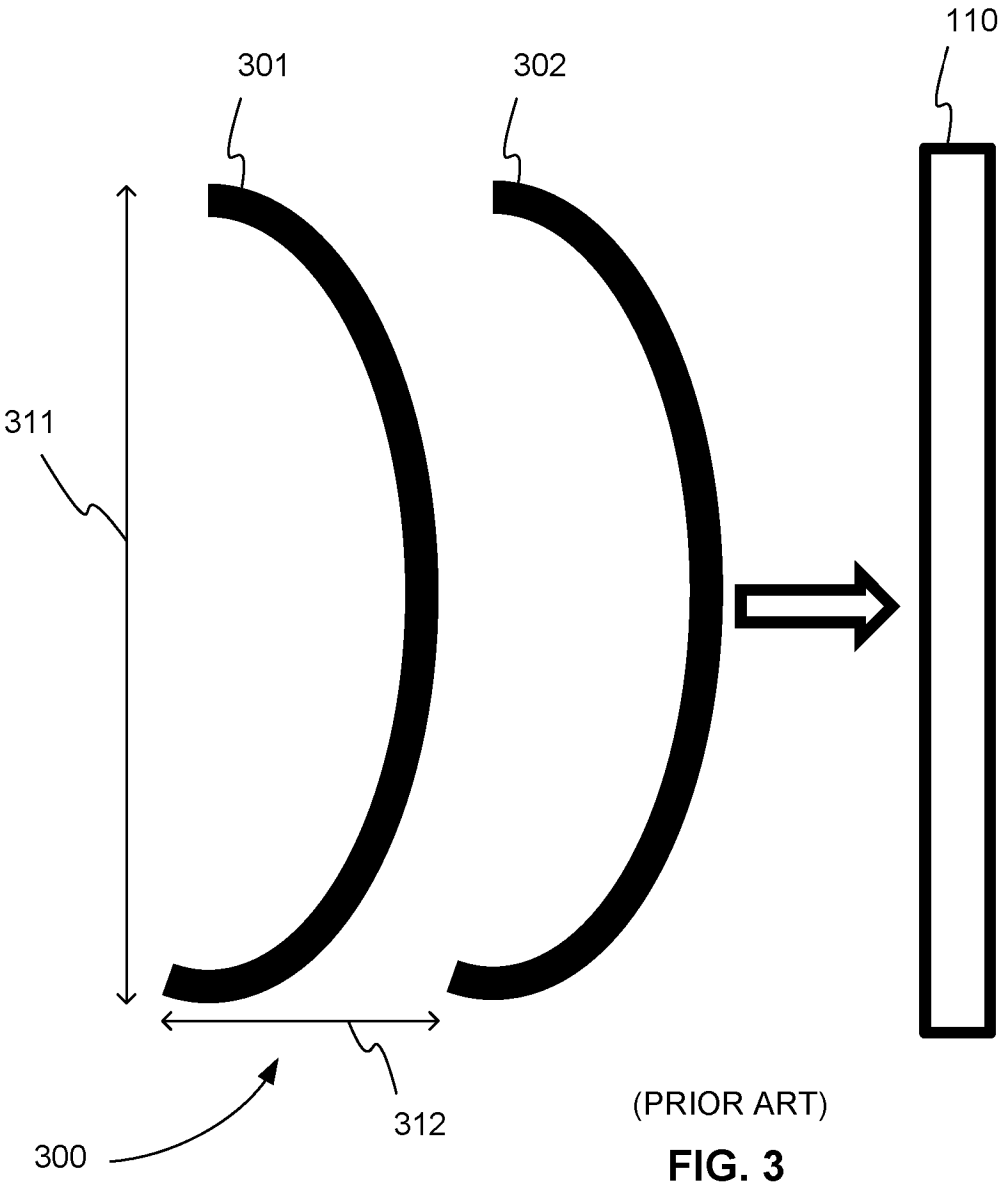
(PRIOR ART) FIG. 3
FIG. 3 is a side view of a TOF ion detection system showing exemplary ion packets that each has a non-ideal shape and an ideal orientation just before they impact an MCP of a TOF ion detection system.

FIG. 3 is a side view 300 of a TOF ion detection system showing exemplary ion packets that each has a non-ideal shape and an ideal orientation just before they impact an MCP of a TOF ion detection system. In FIG. 3, ion packets 301 and 302 have an arched sausage or convex shape with respect to MCP 110. The length 311 of ion packet 301 is about 40 mm, and the depth of convexity 312 of ion packet 301 is much less than 1 mm, for example. The convex shape of ion packets 301 and 302 in TOF mass analyzers is common.

This convex shape reduces the resolution of the ion detection system. Like ion packets 201 and 202 of FIG. 2, ion packets 301 and 302 of FIG. 3 cannot be resolved at MCP 110 if they are much closer than is shown in FIG. 3. This is because, for example, the two trailing edges of ion packet 302 would overlap with the leading edge of ion packet 301 if ion packets 301 and 302 are placed any closer together. Like ion packets, MCPs can also have non-ideal shapes. In practice, MCPs often have a convex shape.

Figure 4:
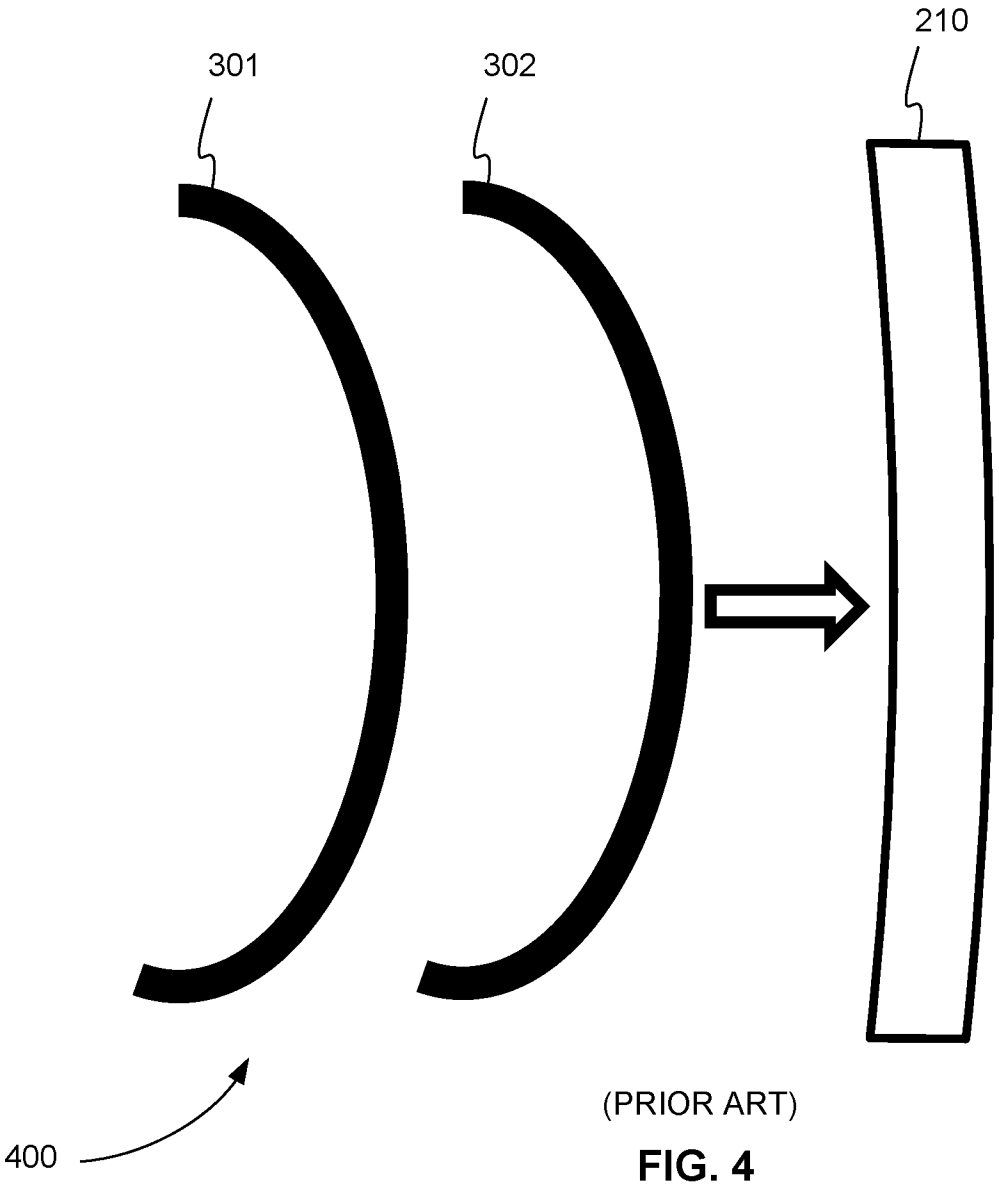
(PRIOR ART) FIG. 4
FIG. 4 is a side view of a TOF ion detection system showing exemplary ion packets that each has a non-ideal shape and an ideal orientation just before they impact an MCP of a TOF ion detection system that also has a non-ideal shape.

FIG. 4 is a side view 400 of a TOF ion detection system showing exemplary ion packets that each has a non-ideal shape and an ideal orientation just before they impact an MCP of a TOF ion detection system that also has a non-ideal shape. In FIG. 4, MCP 210 has a convex shape that is often seen in practice. Any convexity of the MCP will also affect the resolution of the ion detection system.

Although, ion packets 310 and 320 also have convex shapes the amount of convexity seen in MCPs and ion packets typically do not correspond. As a result, both often have to be taken into account in order to improve resolution.

Four-Channel Digitizer

Conventional TOF ion detection systems have compensated for the loss of resolution caused by the convex shape of ion packets and the convex shape of an MCP by using four electrodes and a four-channel digitizer.

Figure 5:
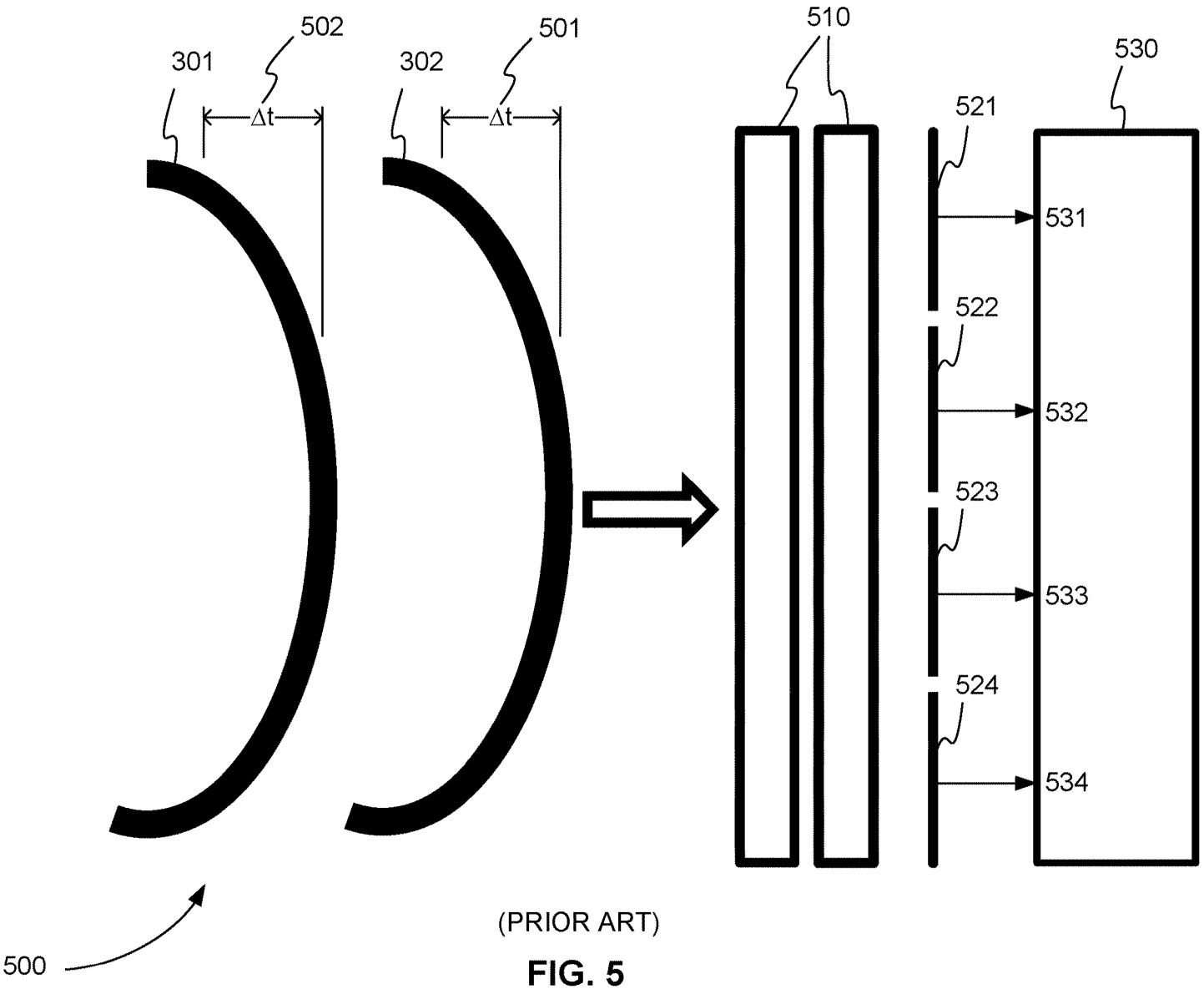
(PRIOR ART) FIG. 5
FIG. 5 is a side view of a TOF ion detection system showing how the digitized signals of exemplary ion packets that each has a non-ideal shape are obtained using four electrodes and a four-channel digitizer to improve resolution.

FIG. 5 is a side view 500 of a TOF ion detection system showing how the digitized signals of exemplary ion packets that each has a non-ideal shape are obtained using four electrodes and a four-channel digitizer to improve resolution. In FIG. 5, two MCPs 510 positioned in series are impacted by ion packets 301 and 302, which have convex shapes. Multiplied electrons produced by MCPs 510 are collected by four segmented anode electrode plates 521, 522, 523, and 524. Each of anode electrode plates 521, 522, 523, and 524 is electrically connected to a separate channel of four-channel digitizer 530.

Four-channel digitizer 530 is, for example, an ADC or a TDC. Each of anode electrode plates 521, 522, 523, and 524 can also be electrically connected to four-channel digitizer 530 through a four-channel preamplifier (not shown), for example. A four-channel preamplifier amplifies the electrical signal received from the electrode plates.

MCPs 510 essentially translate an ion impact image on one side to a corresponding electron emission image on the other side. Although ion packets 301 and 302 have convex shapes, their images on either side of MCPs 510 have a rectangular pattern or shape.

Figure 6:
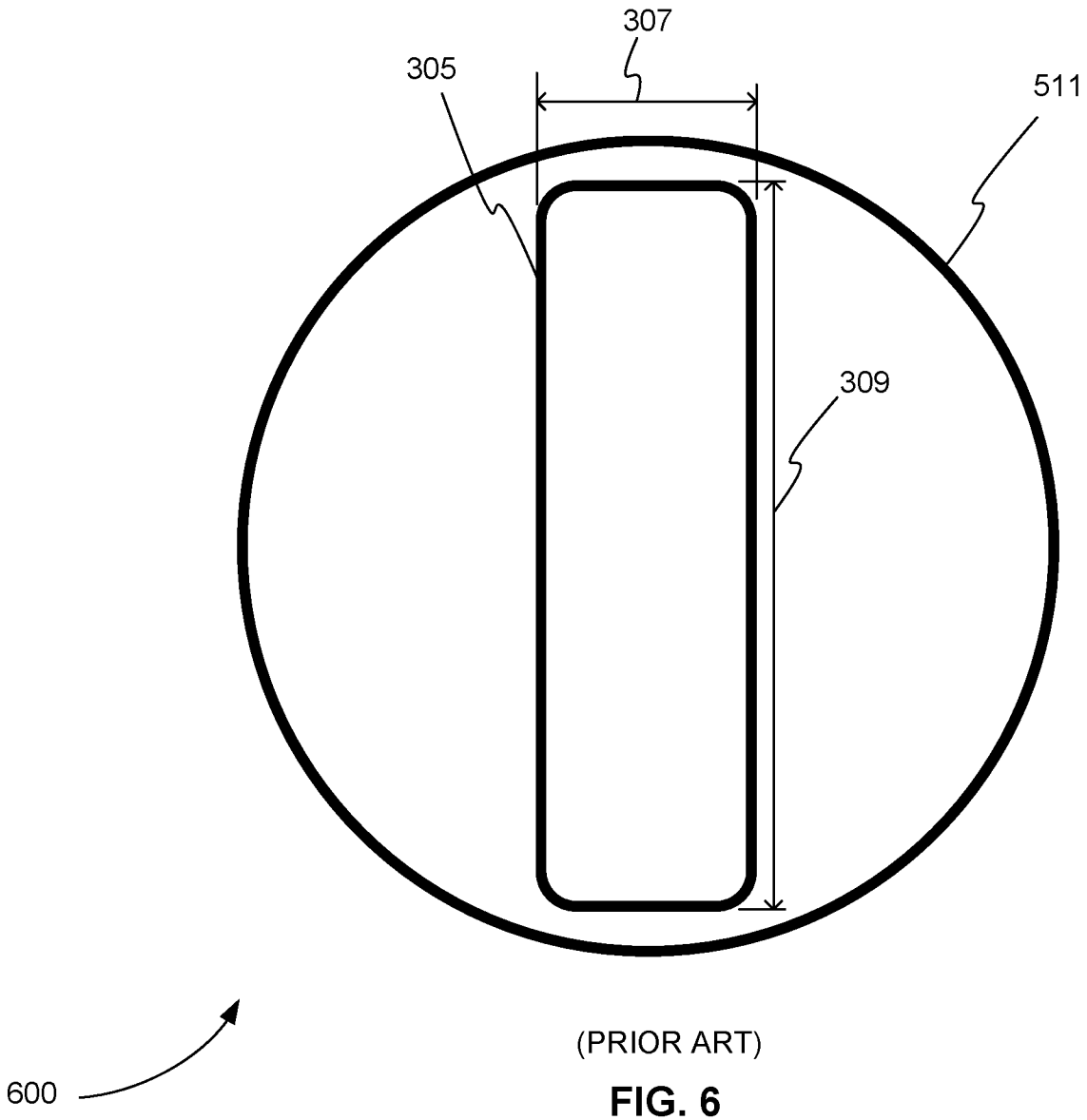
(PRIOR ART) FIG. 6
FIG. 6 is a front view of the impact side of the MCPs of FIG. 5 showing that ion packets impact the MCPs in a rectangular pattern.

FIG. 6 is a front view 600 of the impact side of the MCPs of FIG. 5 showing that ion packets impact the MCPs in a rectangular pattern. In FIG. 6, side 511 of MCPs 510 of FIG. 5 are impacted by ion packets 301 and 302 of FIG. 5 in a rectangular pattern or image 305. Because ion packets 301 and 302 of FIG. 5 have a convex shape, ions of each packet impact the central or inner portion of rectangular pattern 305 of FIG. 6 first. Later in time, ions of each packet impact the outer two edges of rectangular pattern 305. Typically, rectangular pattern 305 has a width 307 of about 10 mm and a length 309 of about 40 mm. Electrons are emitted from the other side of MCPs 510 of FIG. 5 in the same rectangular pattern as rectangular pattern 305.

Figure 7:
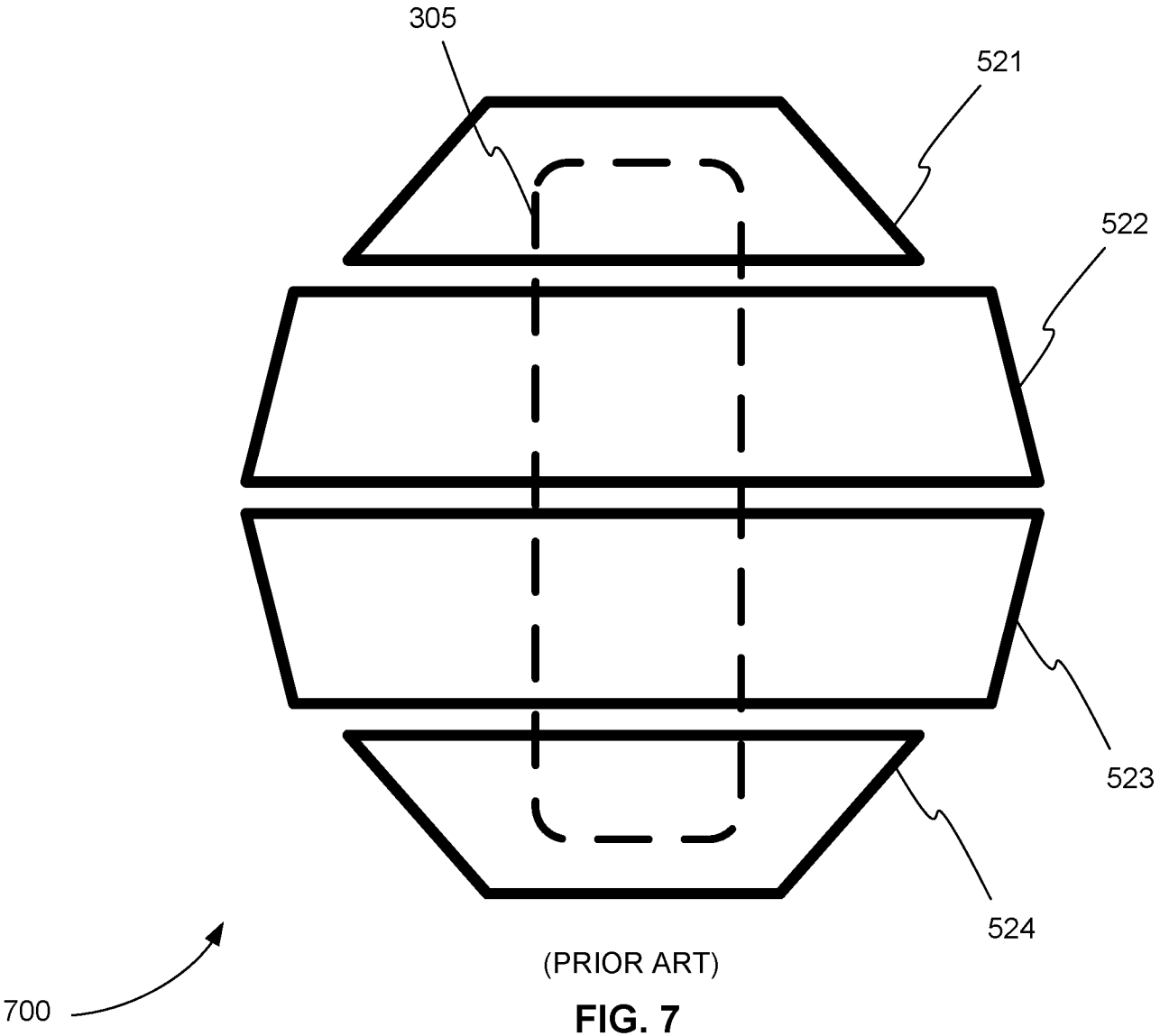
(PRIOR ART) FIG. 7
FIG. 7 is a front view of the four electrodes of FIG. 5.

FIG. 7 is a front view 700 of the four electrodes of FIG. 5. FIG. 7 shows how four segmented anode electrode plates 521, 522, 523, and 524 are positioned to detect ions from a circular MCP, for example. Electrons are emitted onto electrode 521, 522, 523, and 524 using an MCP producing corresponding rectangular pattern 305 of electrons.

Each of anode electrode plates 521, 522, 523, and 524 is able to detect a different part of the rectangular pattern 305 over time. Note that the rectangular pattern is most convex along the length of the rectangular pattern, because the rectangular pattern is much longer than it is wide. By detecting different parts of rectangular pattern 305 over time the convex shape of each ion packet is detected.

Returning to FIG. 5, the four channels 531, 532, 533, and 534 of four-channel digitizer 530 are calibrated to combine or align the measurements from the different channels at different times to account for the lengthwise convexity of the ion packets.

Figure 8:
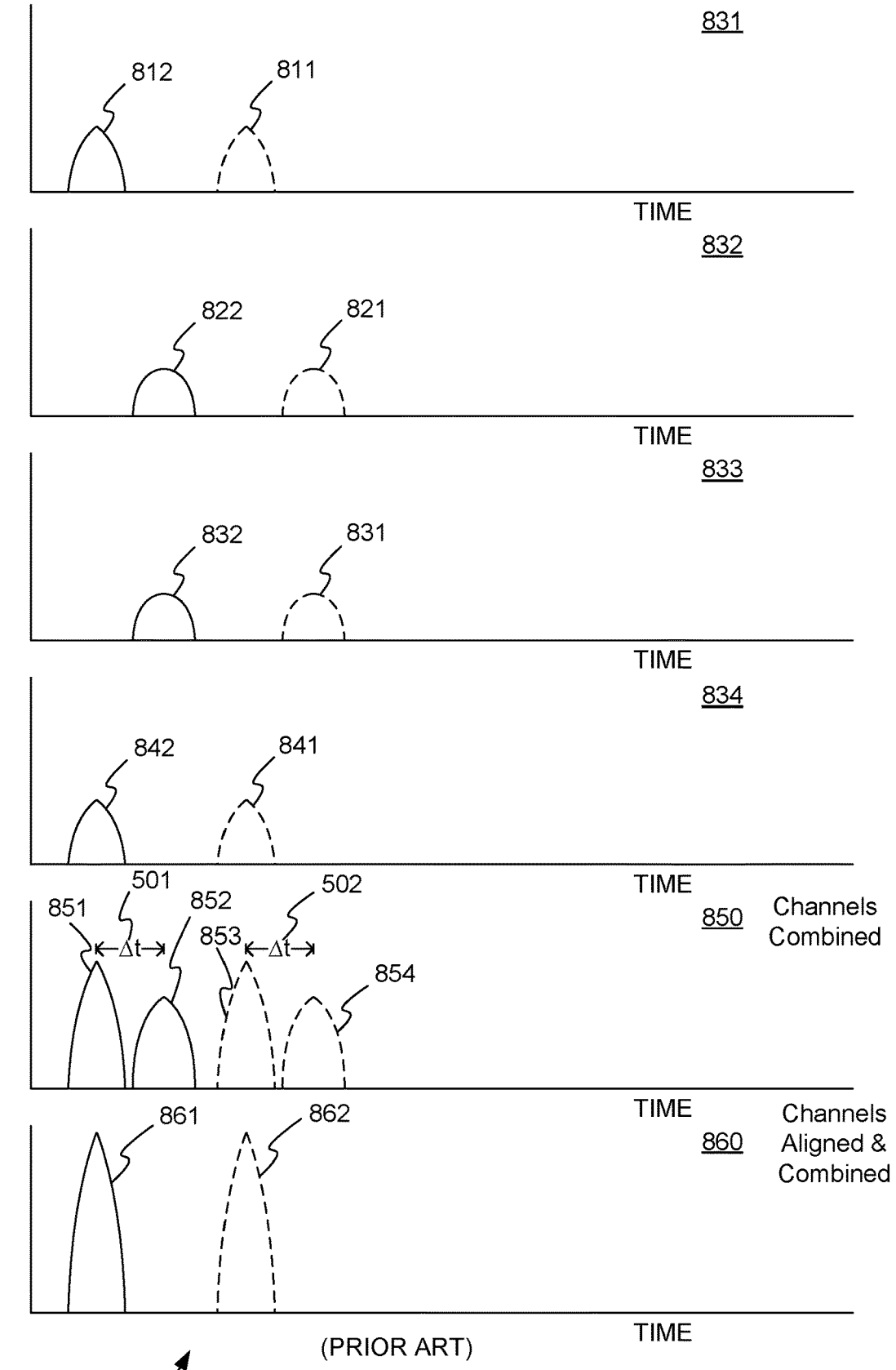
(PRIOR ART) FIG. 8
FIG. 8 is an exemplary series of timing diagrams showing how the measurements from the four channels of the four-channel digitizer in FIG. 5 are aligned or combined to compensate for the non-ideal shape of ion packets and improve the overall resolution of an ion detection system.

FIG. 8 is an exemplary series of timing diagrams 800 showing how the measurements from the four channels of the four-channel digitizer in FIG. 5 are aligned or combined to compensate for the non-ideal shape of ion packets and improve the overall resolution of an ion detection system. Each of the timing diagrams is a plot of the intensity of the electron flux as a function of time.

In FIG. 8, timing diagram 831 shows intensities 812 and 811 for ion packets 302 and 301, respectively, of FIG. 5 measured in channel 531 of four-channel digitizer 530 of FIG. 5. Timing diagram 832 of FIG. 8 shows intensities 822 and 821 for ion packets 302 and 301, respectively, of FIG. 5 measured in channel 532 of four-channel digitizer 530 of FIG. 5. Timing diagram 833 of FIG. 8 shows intensities 832 and 831 for ion packets 302 and 301, respectively, of FIG. 5 measured in channel 533 of four-channel digitizer 530 of FIG. 5. Finally, timing diagram 834 of FIG. 8 shows intensities 842 and 841 for ion packets 302 and 301, respectively, of FIG. 5 measured in channel 534 of four-channel digitizer 530 of FIG. 5.

In timing diagram 850 of FIG. 8, the intensities measured in timing diagrams 831, 832, 833, and 834 are combined. For example, these values are summed in diagram 850. This results in two intensity peaks for each of ion packets 302 and 301 of FIG. 5, one that is a combination of measurements from the two inner electrode plates 522 and 523 of FIG. 5 and one that is a combination of measurements from the two outer electrode plates 521 and 524 of FIG. 5. For example, in timing diagram 850 of FIG. 8, peaks 851 and 852 are the two intensity peaks measured from ion packet 302 of FIG. 5 and peaks 853 and 854 are the two intensity peaks measured from ion packet 301 of FIG. 5.

Note that in FIG. 5, due to the convex shape of the ion packets, the time difference between the detection of the central or inner ions of an ion packet at electrodes 522 and 523 and the detection of the outer ions of an ion packet at electrodes 521 and 524 is Δt 501. In FIG. 8, this Δt 501 as the difference between the centers of peaks 851 and 852 and Δt 502 as the difference between the centers of peaks 853 and 854. This time difference Δt 501 or Δt 502 produced by the convex shapes of the ion packets decreases the detection resolution. It decreases the detection resolution by decreasing the space between the intensities that can be measured for two different packets. In other words, as shown in timing diagram 850, because the intensities of the single ion packet are spread out over time due to the convex shape of the ion packet, the resolution is reduced.

However, because multiple channels are used to measure different parts of the convex shape of an ion packet, it is possible to compensate for the spreading out of intensities. This is shown in timing diagram 860. Essentially, peaks 851 and 852 for ion packet 302 of FIG. 5 are combined into peak 861, and peaks 853 and 854 for ion packet 302 of FIG. 5 are combined into peak 862 in timing diagram 860 of FIG. 8. In other words, digitizer 530 of FIG. 5 is calibrated to align the intensities of channels 531 and 534 with the intensities of channels 532 and 533. This calibration is done, for example, using the calibration equation $m=a\times(t-t_0)^2$, where m is mass, a is slope, t is time, and to is the time offset. Once calibrated, the intensities of all four channels are combined.

Timing diagram 860 of FIG. 8 shows that the resolution has been restored. In other words, the spacing between the peaks (861 and 862) of different packets has been increased. This can be shown more clearly if the ion packets of FIG. 5 are overlapping.

Figure 9:
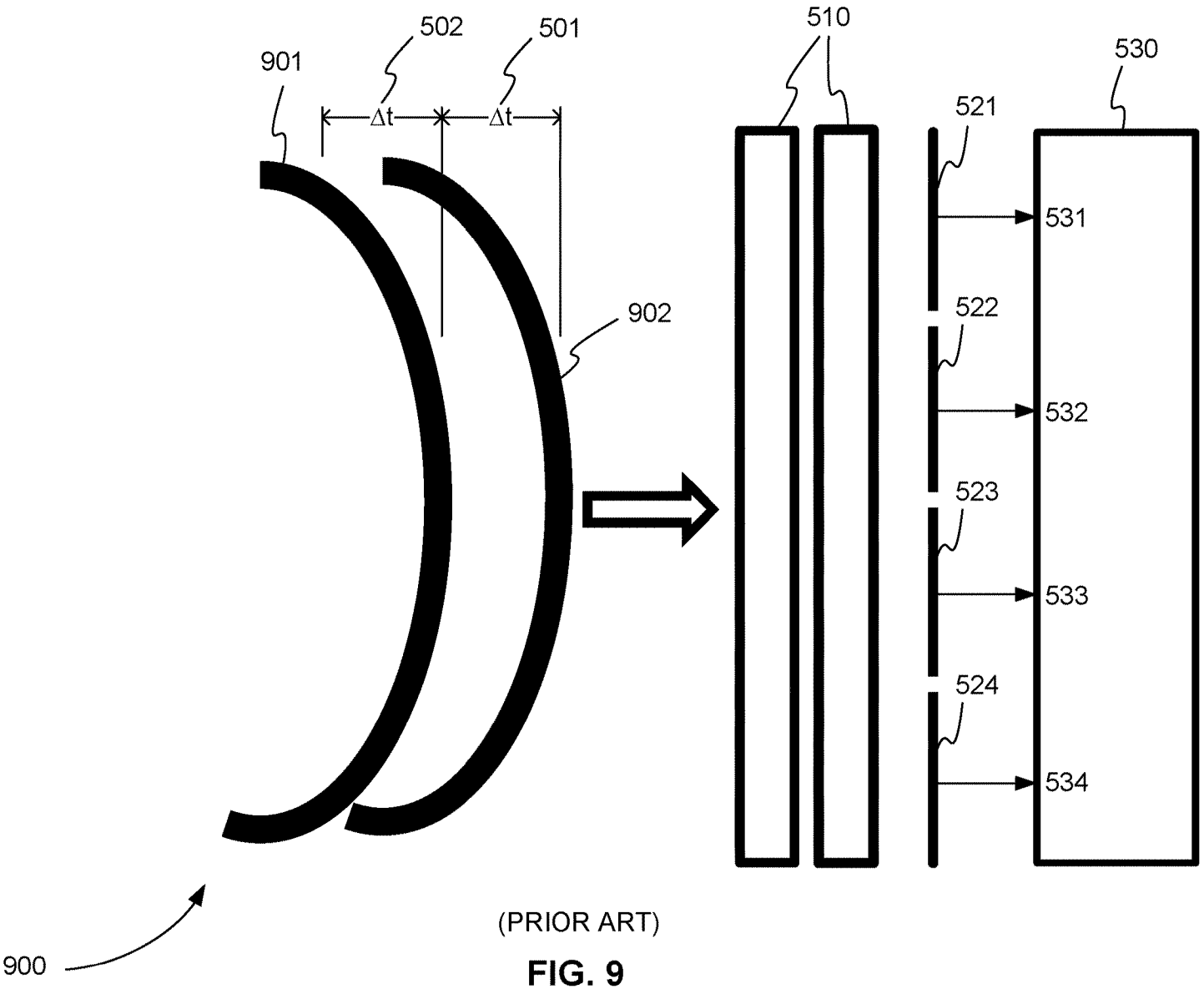
(PRIOR ART) FIG. 9
FIG. 9 is a side view of the same TOF ion detection system as shown in FIG. 5 with exemplary ion packets that overlap.

FIG. 9 is a side view 900 of the same TOF ion detection system as shown in FIG. 5 with exemplary ion packets that overlap. In FIG. 9, the leading of ion packet 901 overlaps with the trailing edge of ion packet 902. If only one electrode and one digitizing channel were used, ion packets 901 and 902 could not be distinguished. However, by using separated electrodes and a four-channel digitizer, packets 901 and 902 can be distinguished.

Figure 10:
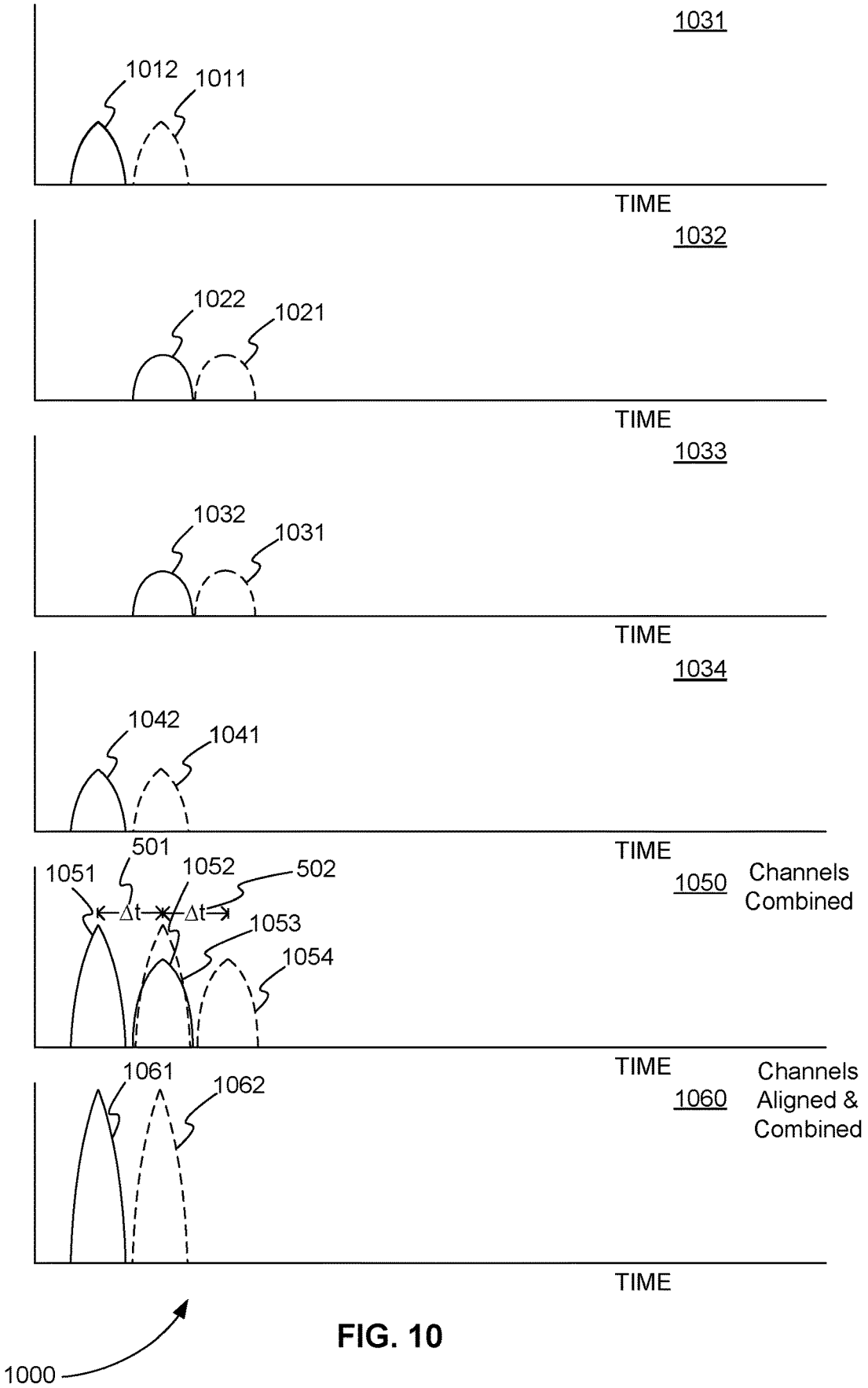
FIG. 10 is an exemplary series of timing diagrams showing how the measurements from the four channels of the four-channel digitizer in FIG. 9 are aligned or combined to compensate for the non-ideal shape of ion packets and improve the overall resolution of an ion detection system even when ion packets overlap.

FIG. 10 is an exemplary series of timing diagrams 1000 showing how the measurements from the four channels of the four-channel digitizer in FIG. 9 are aligned or combined to compensate for the non-ideal shape of ion packets and improve the overall resolution of an ion detection system even when ion packets overlap. In FIG. 10, timing diagram 1031 shows intensities 1012 and 1011 for ion packets 902 and 901, respectively, of FIG. 9 measured in channel 531 of four-channel digitizer 530 of FIG. 9. Timing diagram 1032 of FIG. 10 shows intensities 1022 and 1021 for ion packets 902 and 901, respectively, of FIG. 9 measured in channel 532 of four-channel digitizer 530 of FIG. 9. Timing diagram 1033 of FIG. 10 shows intensities 1032 and 1031 for ion packets 902 and 901, respectively, of FIG. 9 measured in channel 533 of four-channel digitizer 530 of FIG. 9. Finally, timing diagram 1034 of FIG. 10 shows intensities 1042 and 1041 for ion packets 902 and 901, respectively, of FIG. 9 measured in channel 534 of four-channel digitizer 530 of FIG. 9.

In timing diagram 1050 of FIG. 10, the intensities measured in timing diagrams 1031, 1032, 1033, and 1034 are combined. This results in two intensity peaks for each of ion packets 902 and 901 of FIG. 9, one that is a combination of measurements from the two inner electrode plates 522 and 523 of FIG. 9 and one that is a combination of measurements from the two outer electrode plates 521 and 524 of FIG. 9. For example, in timing diagram 1050 of FIG. 10, peaks 1051 and 1052 are the two intensity peaks measured from ion packet 902 of FIG. 9 and peaks 1053 and 1054 are the two intensity peaks measured from ion packet 901 of FIG. 9.

Note in FIG. 10 that peak 1052 of ion packet 902 of FIG. 9 overlaps with peak 1053 of ion packet 901 of FIG. 9. This shows that the overlap caused by the convex shapes of the ion packets in FIG. 9 reduces the resolution.

However, because multiple channels are used to measure different parts of the convex shape of an ion packet, it is possible to compensate for this overlap. This is shown in timing diagram 1060. Essentially, peaks 1051 and 1052 for ion packet 902 of FIG. 9 are combined into peak 1061, and peaks 1053 and 1054 for ion packet 902 of FIG. 9 are combined into peak 1062 in timing diagram 1060 of FIG. 10. This is done, for example, by recalibrating channels 531 and 534 to match peak position on channels 532 and 533. Once recalibrated, the intensities of all four channels are combined and the overlap is eliminated.

Two-Channel Digitizer

As described above, however, four-channel TDC or ADC digitizers are expensive and can account for close to 10% of the cost of a TOF mass spectrometer. In various embodiments, a two-channel digitizer is used instead to reduce the cost of a TOF mass spectrometer.

It is possible to use a two-channel digitizer due to the symmetric nature of the convexity of ion packets and MCPs. As shown in FIG. 8, timing diagrams 831 and 834 for the outer channels have measured intensities at similar times. Likewise, timing diagrams 832 and 833 for the inner channels also have measured intensities at similar times.

As a result, in various embodiments, it is possible to measure intensities from just two sets of electrodes using a two-channel digitizer. For example, in FIG. 7, outer electrodes 521 and 524 can be electrically connected and inner electrodes 521 and 524 can be electrically connected producing just two sets of electrodes. Each of these sets of electrodes can then be connected to a channel of a two-channel digitizer. Similarly, inner electrodes 521 and 524 of FIG. 7 can be combined into a single inner electrode.

Figure 11:
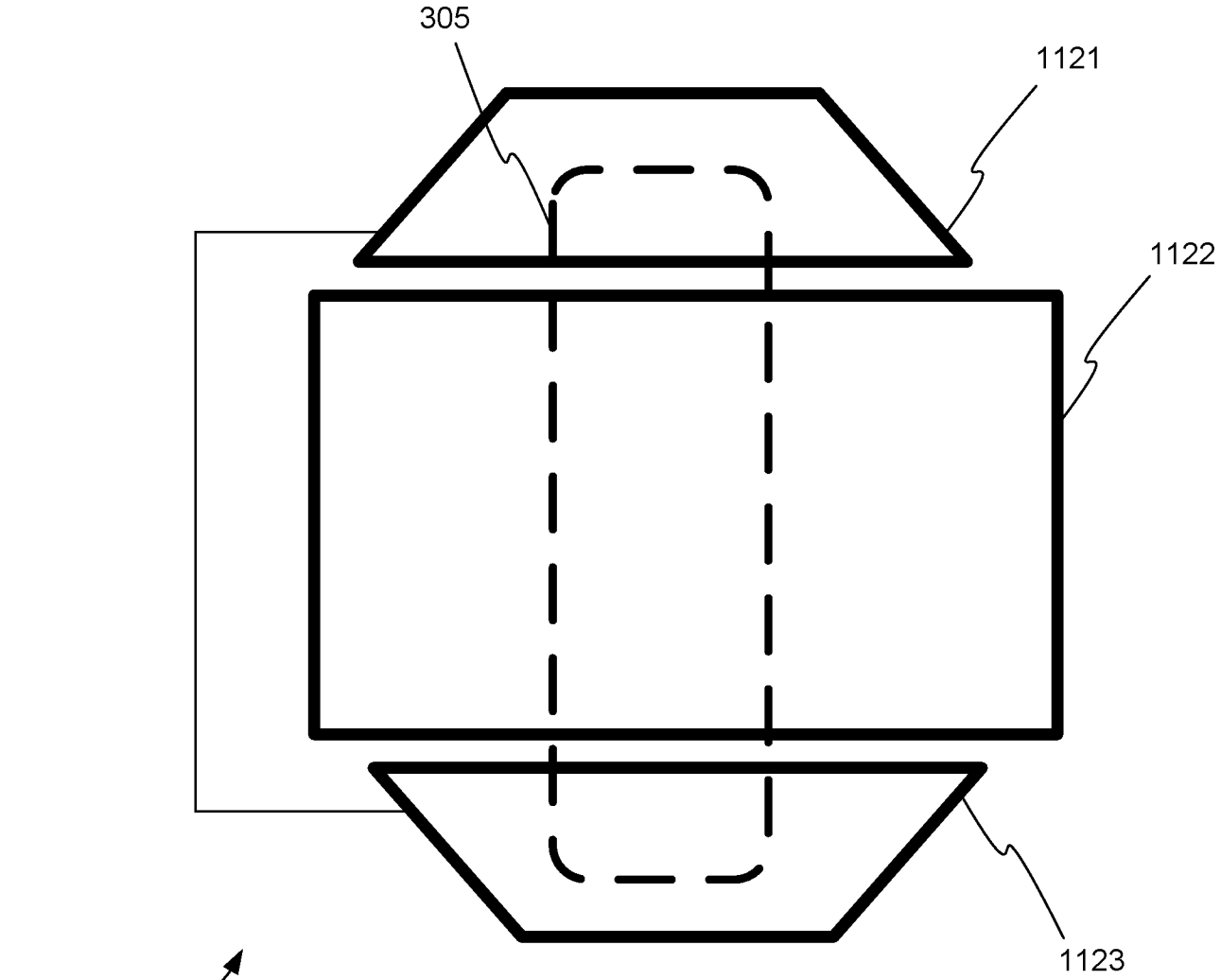
FIG. 11 is a front view of three segmented anode electrode plates showing how three electrodes can be electrically connected producing just two sets of electrodes and used to detect the inner and outer portions of a rectangular pattern of emitted electrons, in accordance with various embodiments.

FIG. 11 is a front view 1100 of three segmented anode electrode plates showing how three electrodes can be electrically connected producing just two sets of electrodes and used to detect the inner and outer portions of a rectangular pattern of emitted electrons, in accordance with various embodiments. In FIG. 11, outer electrode plates 1121 and 1123 are electrically connected, producing a first set of electrodes. Single electrode plate 1122 provides the second set of electrodes. As a result, electrode plates 1121 and 1123 are electrically connected to a first channel of a two-channel digitizer, and electrode plate 1122 is electrically connected to a second channel of the two-channel digitizer.

In this configuration, outer electrode plates 1121 and 1123 detect the outer portions of the rectangular pattern of emitted electrons 305 from an MCP. Similarly, single electrode plate 1122 detects the inner portion of the rectangular pattern of emitted electrons 305 from the MCP.

It is also possible to have two sets of electrodes where each set only includes one electrode. Essentially, an inner or central electrode can be surrounded by an outer ring electrode. Such a configuration can be circular. However, almost any other shape is possible. For example, a central rectangle can be surrounded by a rectangular ring.

Figure 12:
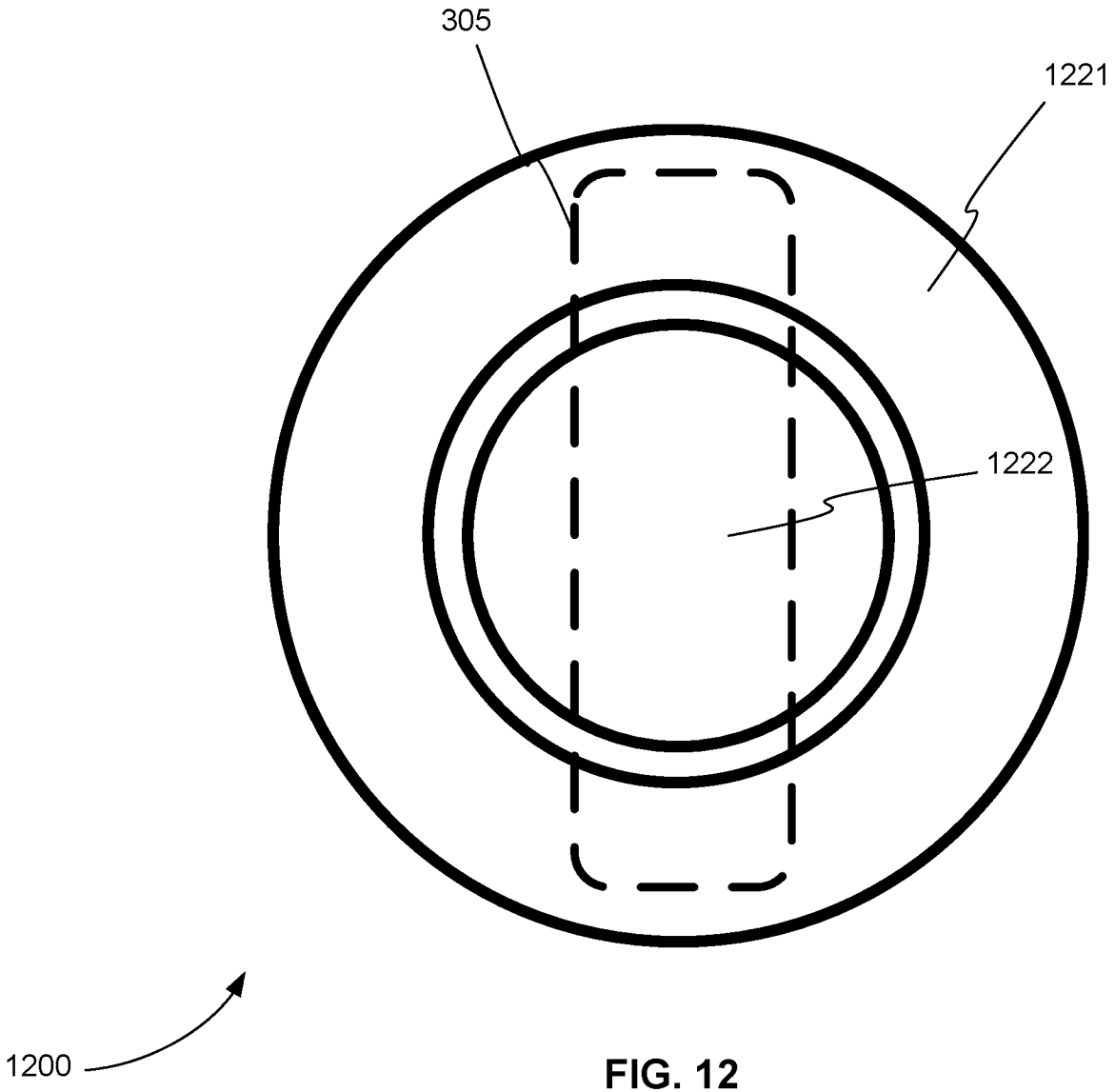
FIG. 12 is a front view of two segmented anode electrode plates showing how just two electrodes can be configured to detect the inner and outer portions of a rectangular pattern of emitted electrons, in accordance with various embodiments.

FIG. 12 is a front view 1200 of two segmented anode electrode plates showing how just two electrodes can be configured to detect the inner and outer portions of a rectangular pattern of emitted electrons, in accordance with various embodiments. In FIG. 12, outer ring electrode plate 1221 is electrically connected to a first channel of a two-channel digitizer. Inner disk electrode plate 1222 is electrically connected to a second channel of the two-channel digitizer.

In this configuration, outer ring electrode plate 1221 detects the outer portions of the rectangular pattern of emitted electrons 305 from an MCP. Similarly, inner disk electrode plate 1222 detects the inner portion of the rectangular pattern of emitted electrons 305 from the MCP.

Two-Channel Digitizer Dynamic Range

As described above, one advantage of a four-channel digitizer is a high dynamic range. Dynamic range is the ratio of the largest and smallest values a digitizer can measure. For example, a four-channel 10-bit ADC has a dynamic range of $4\times2^{10}$ or 4,096.

Replacing a four-channel digitizer with a two-channel digitizer would reduce the dynamic range by a factor of two. However, the dynamic range can be recaptured by increasing the number of bits of the two-channel digitizer. For example, a 14-bit two-channel ADC can be used. In this case, the dynamic range is $2\times2^{14}$ or 32,768 values. As a result, the dynamic range lost by decreasing the number of channels can not only be recovered but it can also be increased by increasing the number of bits used.

Two-Channel Electrical Ion Detection System

Figure 13:
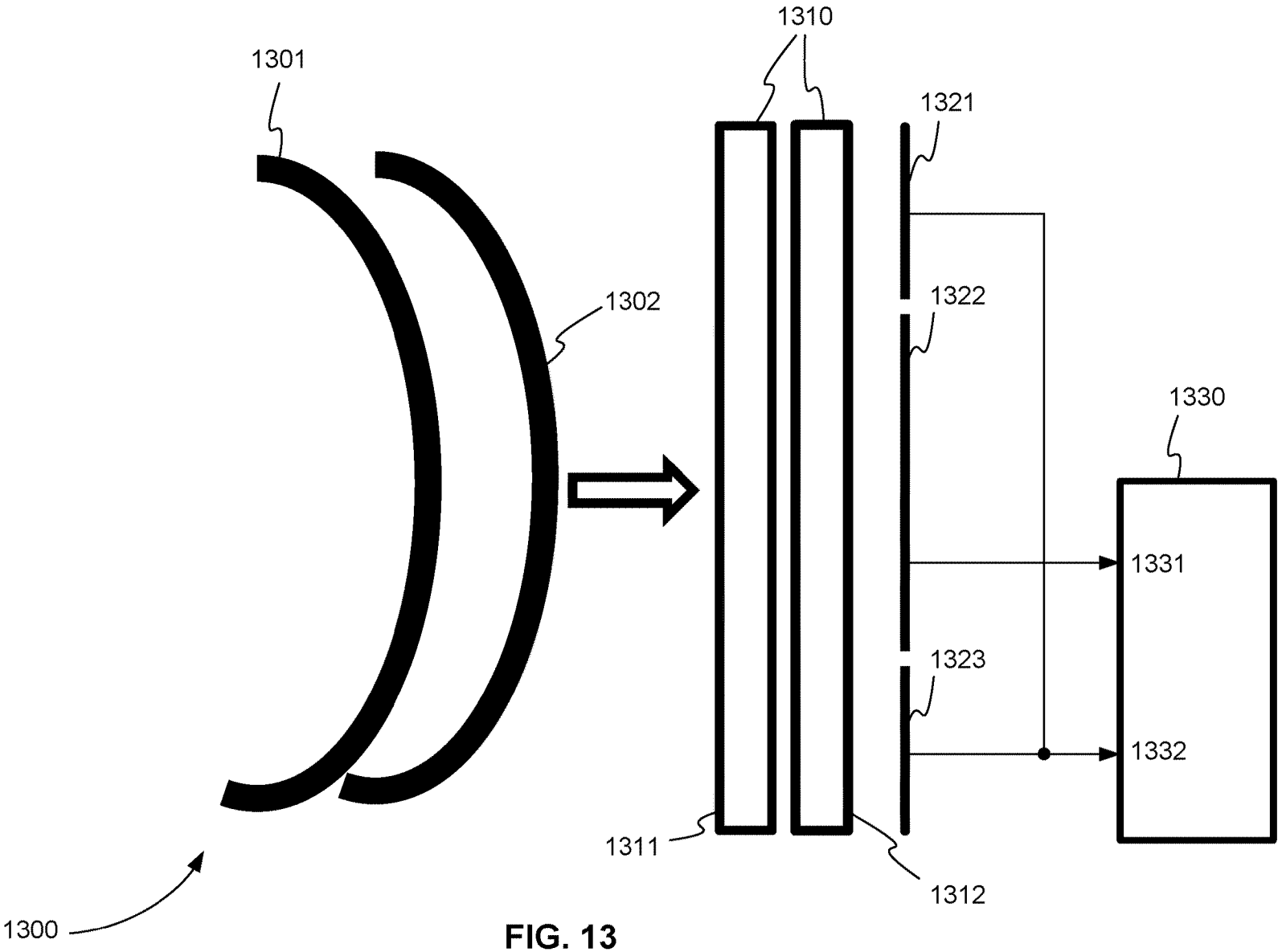
FIG. 13 is a side view of an electrical two-channel ion detection system for a TOF mass analyzer, in accordance with various embodiments.

FIG. 13 is a side view 1300 of an electrical two-channel ion detection system for a time-of-flight (TOF) mass analyzer, in accordance with various embodiments. The electrical two-channel ion detection system includes series of one or more microchannel plates 1310, two or more segmented anode electrodes plates 1321, 1322, and 1323, and two-channel digitizer 1330.

In various embodiments, two-channel digitizer 1330 is a two-channel analog-to-digital converter (ADC). In various embodiments, two-channel digitizer 1330 is a two-channel time-to-digital converter (TDC). Further, in various embodiments, two-channel digitizer 1330 can include a pre-amplifier for each of its two channels.

The first plate of series of one or more microchannel plates 1310 is impacted by ion packets 1301 and 1302 in a rectangular pattern on a first side 1311 of series of one or more microchannel plates 1310. Series of one or more microchannel plates 1310 converts the impacts into multiplied electrons emitted in the rectangular pattern on a second side 1312 of series of one or more microchannel plates 1310. The longer side of the rectangular pattern is the length and a shorter side of the rectangular pattern is the width. Ions of each ion packet impact first side 1311 at different times along the length of the rectangular pattern following a convex shape. Due to the convex shape of ion packets 1301 and 1302, ions of each packet impact a central inner area of the rectangular pattern before impacting two outer areas at each end of the rectangular pattern.

Two or more segmented anode electrode plates 1321, 1322, and 1323 are arranged in a plane parallel with series of one or more microchannel plates 1310. Two or more electrodes 1321, 1322, and 1323 are positioned next to series of one or more microchannel plates 1310 to receive the emitted electrons from the rectangular pattern on second side 1312 of series of one or more microchannel plates 1310. Two or more electrodes 1321, 1322, and 1323 together have an area large enough to receive electrons from the rectangular pattern.

Two or more electrodes 1321, 1322, and 1323 include one or more inner electrodes 1322 positioned to receive emitted electrons from the central inner area of the rectangular pattern. Two or more electrodes 1321, 1322, and 1323 include one or more outer electrodes 1321 and 1323 positioned to receive emitted electrons from the two outer areas at each end of the rectangular pattern.

In various embodiments, the one or more inner electrodes include one inner electrode, as shown in FIG. 11. In various embodiments, the one or more inner electrodes include two inner electrodes that are electrically connected (not shown).

In various embodiments, the one or more outer electrodes include two electrodes that are electrically connected and each of the two electrodes receives electrons from different areas of the two outer areas at each end of the rectangular pattern as shown in FIG. 11.

In various embodiments, the one or more inner electrodes include a single disk electrode, the one or more outer electrodes include a single ring electrode, and the disk electrode and the ring electrode are concentric, as shown in FIG. 12.

Returning to FIG. 13, two-channel digitizer 1330 includes a first channel 1331 electrically connected to one or more inner electrodes 1322. Two-channel digitizer 1330 converts the electrons received by one or more inner electrodes 1322 for each ion packet into a first digital value.

Two-channel digitizer 1330 includes a second channel 1332 electrically connected to one or more outer electrodes 1321 and 1323. Two-channel digitizer 1330 converts the electrons received by one or more outer electrodes 1321 and 1323 for each packet into a second digital value.

First channel 1331 and second channel 1332 are independently calibrated to align the first digital value and the second digital value in time and account for the convex shape of the ion impacts of each ion packet.

In various embodiments, first channel 1331 and second channel 1332 are further independently calibrated to align the first digital value and the second value digital in time and account for curvature of series of one or more microchannel plates 1310.

Two-Channel Photo-Electrical Ion Detection System

In various embodiments, a two-channel ion detection system for a TOF mass analyzer can include optical components to detect the electrons produced by series of one or more MCPs. Essentially, these optical components replace the segmented anode electrode plates of the electrical systems described above. As a result, all of the configurations of electrodes described above also apply to the optical components or light pipes of a photo-electrical system.

Figure 14:
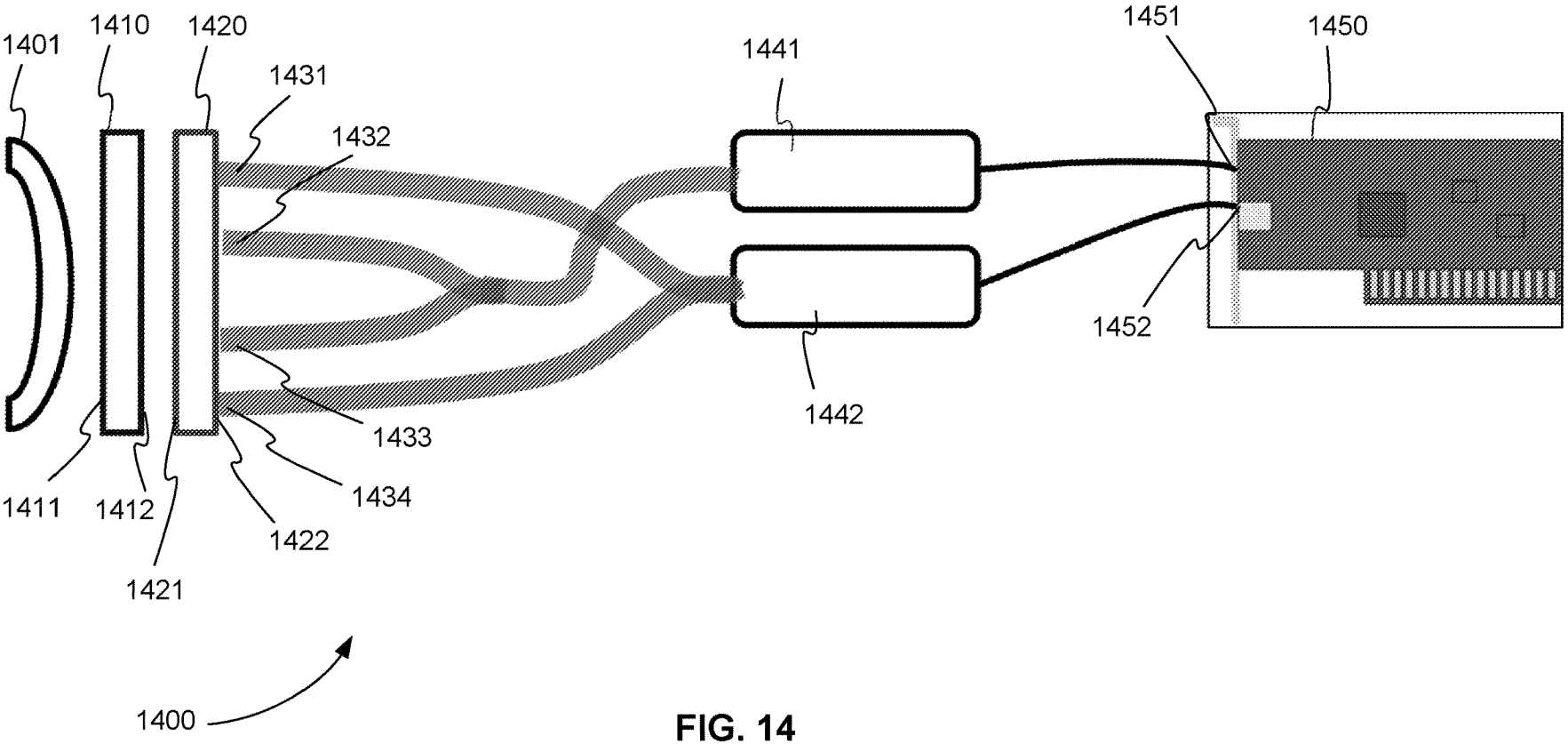
FIG. 14 is a side view of a photo-electrical two-channel ion detection system for a TOF mass analyzer, in accordance with various embodiments.

FIG. 14 is a side view 1400 of a photo-electrical two-channel ion detection system for a TOF mass analyzer, in accordance with various embodiments. The photo-electrical two-channel ion detection system includes series of one or more microchannel plates 1410, scintillator 1420, two or more segmented light pipes 1431, 1432, 1433 and 1434, first photo-multiplier tube (PMT) 1441, second PMT 1442, and two-channel digitizer 1450.

In various embodiments, two-channel digitizer 1450 is a two-channel analog-to-digital converter (ADC). In various embodiments, two-channel digitizer 1450 is a two-channel time-to-digital converter (TDC).

The first one of series of one or more microchannel plates 1410 is impacted by ion packets 1401 in a rectangular pattern on a first side 1411 of series of one or more microchannel plates 1410. Series of one or more microchannel plates 1410 converts the impacts into multiplied electrons emitted in the rectangular pattern on a second side 1412 of series of one or more microchannel plates 1410. A longer side of the rectangular pattern is the length and a shorter side of the rectangular pattern is the width. Due to the convex shape of ion packet 1401, for example, ions of each packet impact a central inner area of the rectangular pattern before impacting two outer areas at each end of the rectangular pattern.

Scintillator 1420 is positioned in parallel with series of one or more microchannel plates 1410 and next to series of one or more microchannel plates 1410. Scintillator 1420 receives the emitted electrons in the rectangular pattern on a first side 1421 of scintillator 1420 from second side 1412 of series of one or more microchannel plates 1410. Scintillator 1420 converts the electrons into photons emitted in the rectangular pattern on a second side 1422 of scintillator 1420.

Two or more segmented light pipes 1431, 1432, 1433, and 1434 are connected to second side 1422 of scintillator 1420 to receive the photons from second side 1422 of scintillator 1420. Two or more segmented light pipes 1431, 1432, 1433, and 1434 together have an area large enough to receive photons from the rectangular pattern. Two or more light pipes 1431, 1432, 1433, and 1434 include one or more inner light pipes 1432 and 1433 positioned to receive photons from the central inner area of the rectangular pattern. Two or more light pipes 1431, 1432, 1433, and 1434 include one or more outer light pipes 1431 and 1434 positioned to receive photons from the two outer areas at each end of the rectangular pattern.

In various embodiments, the one or more inner light pipes include one light pipe, similar to the one electrode of FIG. 11. In various embodiments, the one or more light pipes include two inner light pipes that are connected, as shown in FIG. 14.

In various embodiments, the one or more outer light pipes include two light pipes that are connected and each of the two light pipes receives photons from different areas of the two outer areas at each end of the rectangular pattern as shown in FIG. 14.

In various embodiments, the one or more inner light pipes include a single disk light pipe, the one or more outer light pipes include a single ring light pipe, and the disk light pipe and the ring light pipe are concentric, similar to the electrodes shown in FIG. 12.

Returning to FIG. 14, first photo-multiplier tube 1441 is connected to one or more inner light pipes 1432 and 1433 and converts the photons received by one or more inner light pipes 1432 and 1433 into first multiplied electrons for each packet. Second photo-multiplier tube 1442 is connected to one or more outer light pipes 1431 and 1434 and converts the photons received by one or more outer light pipes 1431 and 1434 into second multiplied electrons for each packet.

Two-channel digitizer 1450 includes a first channel 1451 electrically connected to first photo-multiplier tube 1441 that converts the first multiplied electrons for each ion packet into a first digital value. Two-channel digitizer 1450 includes a second channel 1452 electrically connected to second photo-multiplier tube 1442 that converts the second multiplied electrons for each ion packet into a second digital value.

First channel 1451 and second channel 1452 are independently calibrated to align the first digital value and the second digital value in time and account for the convex shape of the ion impacts of each ion packet.

In various embodiments, first channel 1451 and second channel 1452 are further independently calibrated to align the first digital value and the second digital value in time and account for the curvature of series of one or more microchannel plates 1410.

Two-Channel Planar Photo-Electrical Ion Detection System

In various embodiments, a two-channel ion detection system for a TOF mass analyzer can include a planar ion-to-electron converter, a magnetic field, and optical components to detect ions. Essentially, the planar ion-to-electron converter, a combination of electric and magnetic fields, and optical components replace the MCPs and the segmented anode electrode plates of the electrical systems described above.

Figure 15:
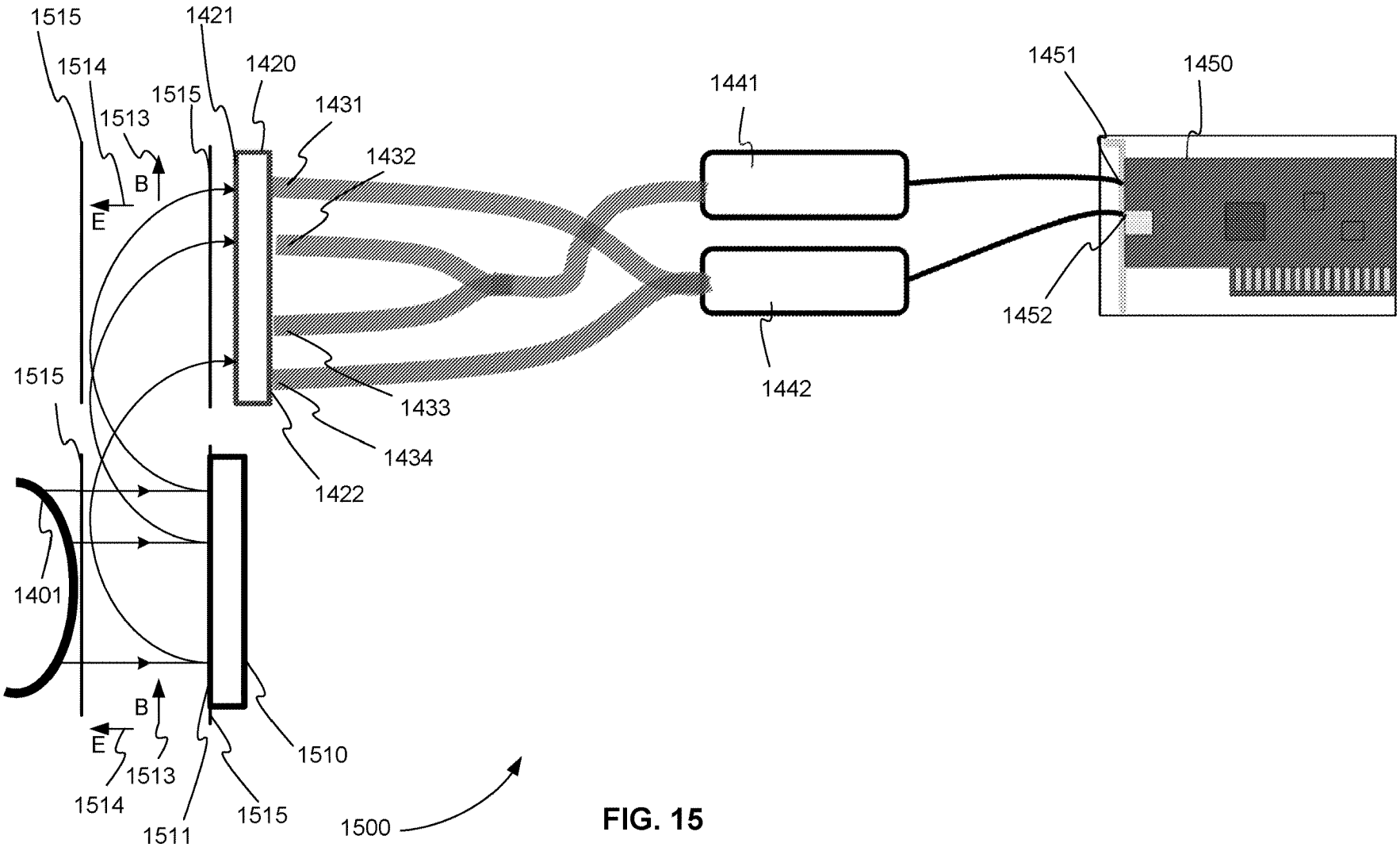
FIG. 15 is a side view of a planar ion-to-electron photo-electrical two-channel ion detection system for a TOF mass analyzer, in accordance with various embodiments.

FIG. 15 is a side view 1500 of a planar ion-to-electron photo-electrical two-channel ion detection system for a TOF mass analyzer, in accordance with various embodiments. The planar ion-to-electron photo-electrical two-channel ion detection system includes planar ion-to-electron converter 1510, normal magnetic field 1513, scintillator 1420, two or more segmented light pipes 1431, 1432, 1433 and 1434, first photo-multiplier tube (PMT) 1441, second PMT 1442, and two-channel digitizer 1450.

In various embodiments, two-channel digitizer 1450 is a two-channel analog-to-digital converter (ADC). In various embodiments, two-channel digitizer 1450 is a two-channel time-to-digital converter (TDC).

Planar ion-to-electron converter 1510 is impacted by ion packets 1401 in a rectangular pattern on a first side 1511 of planar ion-to-electron converter 1510. Planar ion-to-electron converter 1510 includes a material that has high electron emission probability per impinging ion such as CVD diamond or oxides or other materials known for their high secondary emission coefficients.

The two-channel ion detection system further includes a DC homogeneous magnetic field 1513 from a permanent or electromagnet (not shown). Magnetic field 1513 is established in front of planar ion-to-electron converter 1510 and scintillator 1420. Electric field 1414 is also established in front of planar ion-to-electron converter 1510 and scintillator 1420. Electric field 1514 is established by appropriately biasing highly transparent meshes 1515 using a voltage source (not shown), for example. Electric field 1514 and magnetic field 1513 are designed to cause electrons also emitted from first side 1511 of planar ion-to-electron converter 1510 to move in a semi-circular path to scintillator 1420. U.S. Pat. No. 7,180,060, which is herein incorporated by reference, describes use of a planar ion-to-electron converter, a magnetic field, and an electric field to move electrons emitted from ions in a semi-circular path to a detector member.

Planar ion-to-electron converter 1510 converts the impacts into electrons emitted in the same rectangular pattern on the same first side 1511 of planar ion-to-electron converter 1510. A longer side of the rectangular pattern is the length and a shorter side of the rectangular pattern is the width. Due to the convex shape of ion packet 1401, for example, ions of each packet impact a central inner area of the rectangular pattern before impacting two outer areas at each end of the rectangular pattern.

Scintillator 1420 is positioned side by side with planar ion-to-electron converter 1510. Scintillator 1420 receives the emitted electrons in the rectangular pattern on a first side 1421 of scintillator 1420 from first side 1511 of planar ion-to-electron converter 1510. Scintillator 1420 converts the electrons into photons emitted in the rectangular pattern on a second side 1422 of scintillator 1420.

Two or more segmented light pipes 1431, 1432, 1433, and 1434 are connected to second side 1422 of scintillator 1420 to receive the photons from second side 1422 of scintillator 1420. Two or more segmented light pipes 1431, 1432, 1433, and 1434 together have an area large enough to receive photons from the rectangular pattern. Two or more light pipes 1431, 1432, 1433, and 1434 include one or more inner light pipes 1432 and 1433 positioned to receive photons from the central inner area of the rectangular pattern. Two or more light pipes 1431, 1432, 1433, and 1434 include one or more outer light pipes 1431 and 1434 positioned to receive photons from the two outer areas at each end of the rectangular pattern.

In various embodiments, the one or more inner light pipes include one light pipe, similar to the one electrode of FIG. 11. In various embodiments, the one or more light pipes include two inner light pipes that are connected, as shown in FIG. 15.

In various embodiments, the one or more outer light pipes include two light pipes that are connected and each of the two light pipes receives photons from different areas of the two outer areas at each end of the rectangular pattern as shown in FIG. 15.

In various embodiments, the one or more inner light pipes include a single disk light pipe, the one or more outer light pipes include a single ring light pipe, and the disk light pipe and the ring light pipe are concentric, similar to the electrodes shown in FIG. 12.

Returning to FIG. 15, first photo-multiplier tube 1441 is connected to one or more inner light pipes 1432 and 1433 and converts the photons received by one or more inner light pipes 1432 and 1433 into first multiplied electrons for each packet. Second photo-multiplier tube 1442 is connected to one or more outer light pipes 1431 and 1434 and converts the photons received by one or more outer light pipes 1431 and 1434 into second multiplied electrons for each packet.

Two-channel digitizer 1450 includes a first channel 1451 electrically connected to first photo-multiplier tube 1441 that converts the first multiplied electrons for each ion packet into a first digital value. Two-channel digitizer 1450 includes a second channel 1452 electrically connected to second photo-multiplier tube 1442 that converts the second multiplied electrons for each ion packet into a second digital value.

First channel 1451 and second channel 1452 are independently calibrated to align the first digital value and the second digital value in time and account for the convex shape of the ion impacts of each ion packet.

In various embodiments, first channel 1451 and second channel 1452 are further independently calibrated to align the first digital value and the second digital value in time and account for the curvature of series of one or more microchannel plates 1410.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. An electrical two-channel ion detection system for a time-of-flight (TOF) mass analyzer, comprising:

a series of one or more microchannel plates that is impacted by ion packets in a rectangular pattern on a first side of the series of one or more microchannel plates and converts the impacts into multiplied electrons emitted in the rectangular pattern on a second side of the series of one or more microchannel plates, wherein a longer side of the rectangular pattern is the length and a shorter side of the rectangular pattern is the width and wherein ions of each ion packet impact the first side at different times along the length of the rectangular pattern following a convex shape with ions of each packet impacting a central inner area of the rectangular pattern before impacting two outer areas at each end of the rectangular pattern;

two or more segmented anode electrodes plates arranged in a plane parallel with the series of one or more microchannel plates and positioned next to the series of one or more microchannel plates to receive the emitted electrons from the rectangular pattern on the second side of the series of one or more microchannel plates, wherein the two or more electrodes together have an area large enough to receive electrons from the rectangular pattern and wherein two or more electrodes include one or more inner electrodes positioned to receive emitted electrons from the central inner area of the rectangular pattern and one or more outer electrodes positioned to receive emitted electrons from the two outer areas at each end of the rectangular pattern; and a two-channel digitizer that includes a first channel electrically connected to the one or more inner electrodes that converts the electrons received by the one or more inner electrodes for each ion packet into a first digital value and a second channel electrically connected to the one or more outer electrodes that converts the electrons received by the one or more outer electrodes for each packet into a second digital value, wherein the first channel and the second channel are independently calibrated to align the first digital value and the second digital value in time and account for the convex shape of the ion impacts of each ion packet.

2. The electrical system of claim 1, wherein the one or more inner electrodes comprise one inner electrode.

3. The electrical system of claim 1, wherein the one or more inner electrodes comprise two inner electrodes that are electrically connected.

4. The electrical system of claim 1, wherein the one or more outer electrodes comprise two electrodes that are electrically connected and each of the two electrodes receives electrons from different areas of the two outer areas at each end of the rectangular pattern.

5. The electrical system of claim 1, wherein the one or more inner electrodes comprise a single disk electrode, the one or more outer electrodes comprise a single ring electrode, and the disk electrode and the ring electrode are concentric.

6. The electrical system of claim 1, wherein the two-channel digitizer is a two-channel analog-to-digital converter (ADC).

7. The electrical system of claim 1, wherein the two-channel digitizer is a two-channel time-to-digital converter (TDC).

8. The electrical system of claim 1, wherein the first channel and the second channel are further independently calibrated to align the first digital value and the second digital value in time and account for curvature of the series of one or more microchannel plates.

9. A photo-electrical two-channel ion detection system for a time-of-flight mass spectrometer, comprising:

a series of one or more microchannel plates that is impacted by ion packets in a rectangular pattern on a first side of the series of one or more microchannel plates and converts the impacts into multiplied electrons emitted in the rectangular pattern on a second side of the series of one or more microchannel plates, wherein a longer side of the rectangular pattern is the length and a shorter side of the rectangular pattern is the width and wherein ions of each ion packet impact the first side at different times along the length of the rectangular pattern following a convex shape with ions of each packet impacting a central inner area of the rectangular pattern before impacting two outer areas at each end of the rectangular pattern;

a scintillator positioned in parallel with the series of one or more microchannel plates and positioned next to the series of one or more microchannel plates that receives the emitted electrons in the rectangular pattern on a first side of the scintillator from the second side of the series of one or more microchannel plates and converts the electrons into photons emitted in the rectangular pattern on a second side of the scintillator;

two or more segmented light pipes connected to the second side of the scintillator to receive the photons from the second side of the scintillator, wherein the two or more pipes together have an area large enough to receive photons from the rectangular pattern and wherein two or more light pipes include one or more inner light pipes positioned to receive photons from the central inner area of the rectangular pattern and one or more outer light pipes positioned to receive photons from the two outer areas at each end of the rectangular pattern;

a first photo-multiplier tube connected to the one or more inner light pipes that converts the photons received by the one or more inner light pipes into first multiplied electrons for each packet;

a second photo-multiplier tube connected to the one or more outer light pipes that converts the photons received by the one or more outer light pipes into second multiplied electrons for each packet; and a two-channel digitizer that includes a first channel electrically connected to the first photo-multiplier tube that converts the first multiplied electrons for each ion packet into a first digital value and a second channel electrically connected to the second photo-multiplier tube that converts the second multiplied electrons for each packet into a second digital value, wherein the first channel and the second channel are independently calibrated to align the first digital value and the second digital value in time and account for the convex shape of the ion impacts of each ion packet.

10. The photo-electrical system of claim 9, wherein the one or more inner light pipes comprise one inner electrode.

11. The photo-electrical system of claim 9, wherein the one or more inner light pipes comprise two inner light pipes that are connected.

12. The photo-electrical system of claim 9, wherein the one or more outer light pipes comprise two light pipes that are connected and each of the two light pipes receives photons from different areas of the two outer areas at each end of the rectangular pattern.

13. The photo-electrical system of claim 9, wherein the one or more inner light pipes comprise a single disk light pipe, the one or more outer light pipes comprise a single ring light pipe, and the disk light pipe and the ring light pipe are concentric.

14. The photo-electrical system of claim 9, wherein the two-channel digitizer is a two-channel analog-to-digital converter (ADC) or a two-channel time-to-digital converter (TDC).

15. A planar photo-electrical two-channel ion detection system for a time-of-flight mass spectrometer, comprising:

a magnet to produce a magnetic field;

a plurality of conducting meshes that are transparent to ions that are biased by a voltage source to produce an electric field;

a planar ion-to-electron converter that is impacted by ion packets in a rectangular pattern on a first side of the planar ion-to-electron converter and converts the impacts into multiplied electrons emitted in the rectangular pattern on the same first side of the planar ion-to-electron converter, wherein a longer side of the rectangular pattern is the length and a shorter side of the rectangular pattern is the width and wherein ions of each ion packet impact the first side at different times along the length of the rectangular pattern following a convex shape with ions of each packet impacting a central inner area of the rectangular pattern before impacting two outer areas at each end of the rectangular pattern;

a scintillator positioned side by side with the planar ion-to-electron converter that receives the emitted electrons in the rectangular pattern on a first side of the scintillator from the first side of the planar ion-to-electron converter and converts the electrons into photons emitted in the rectangular pattern on a second side of the scintillator, wherein the magnet and the plurality of conducting meshes are positioned to create the magnetic field and the electric field in front of the first side of the planar ion-to-electron converter and the first side of the scintillator so that the magnetic field and the electric field send the emitted electrons in a semi-circular path from the planar ion-to-electron converter to the scintillator;

two or more segmented light pipes connected to the second side of the scintillator to receive the photons from the second side of the scintillator, wherein the two or more pipes together have an area large enough to receive photons from the rectangular pattern and wherein two or more light pipes include one or more inner light pipes positioned to receive photons from the central inner area of the rectangular pattern and one or more outer light pipes positioned to receive photons from the two outer areas at each end of the rectangular pattern;

a first photo-multiplier tube connected to the one or more inner light pipes that converts the photons received by the one or more inner light pipes into first multiplied electrons for each packet;

a second photo-multiplier tube connected to the one or more outer light pipes that converts the photons received by the one or more outer light pipes into second multiplied electrons for each packet; and a two-channel digitizer that includes a first channel electrically connected to the first photo-multiplier tube that converts the first multiplied electrons for each ion packet into a first digital value and a second channel electrically connected to the second photo-multiplier tube that converts the second multiplied electrons for each packet into a second digital value, wherein the first channel and the second channel are independently calibrated to align the first digital value and the second digital value in time and account for the convex shape of the ion impacts of each ion packet.

* * * * *